US006050274A

United States Patent [19]

Gelardi et al.

[11] Patent Number: 6,050,274

[45] Date of Patent: Apr. 18, 2000

[54] APPLICATOR

[75] Inventors: John A. Gelardi, Kennebunkport; Anthony L. Gelardi, P.O. Box 213; Tatiana L. Gelardi, both of Cape Porpoise, all of Me.

[73] Assignee: Anthony L. Gelardi, Kennebunkport, Me.

[21] Appl. No.: 09/337,259

[22] Filed: Jun. 22, 1999

Related U.S. Application Data

[60] Provisional application No. 60/110,760, Dec. 3, 1998.

[51] Int. Cl.[7] ..... A45D 40/26

[52] U.S. Cl. ..... 132/320; 132/311; 401/6; 401/140; 15/144.2

[58] Field of Search ..... 132/320, 311, 132/207, 317, 218, 286; 401/6, 140, 207, 205, 290, 266, 196, 202, 203; 15/244.2, 144.2, 244.1, 104.92, 244.3, 244.4

[56] References Cited

U.S. PATENT DOCUMENTS

| | | | |
|---|---|---|---|
| 2,897,526 | 8/1959 | Dootson | 132/320 |
| 4,483,636 | 11/1984 | Meyer | 401/266 |
| 4,887,924 | 12/1989 | Green | 401/266 |
| 5,638,990 | 6/1997 | Kastberg | 222/106 |
| 5,813,785 | 9/1998 | Baudin et al. | 401/266 |
| 5,823,206 | 10/1998 | Mapleback | 132/320 |
| 5,908,256 | 6/1999 | Berstein | 401/207 |

*Primary Examiner*—Gene Mancene
*Assistant Examiner*—Pedro Philogene
*Attorney, Agent, or Firm*—James Creighton Wray; Meera P. Narasimhan

[57] ABSTRACT

A unitary applicator formed in a single mold, which may be formed with the container, filled, sealed and ready for packaging and shipping at a lower cost. The applicator head may also be manufactured for later attachment to a container, such as by fusing, welding or bonding, or by preconstructed mechanical connectors. A mold with movable parts allows construction of the applicator with two shots of material. The first shot forms structural parts of the applicator and container, and a subsequent shot of softer material forms the applicator surfaces. In addition, non-slip surfaces may be formed by the second shot on parts of the container that is hand held during applications of the flowable material to skin or other substrates or surfaces. The use of non-open cell materials to form the contact surface improves hygiene by reducing contamination of the applicator. The reduction of dead space in the cap minimizes waste by allowing almost all of the contents to be dispensed.

20 Claims, 56 Drawing Sheets

APPLICATOR

This application claims the benefit of U.S. provisional application Ser. No. 60/110,760, filed Dec. 3, 1998.

BACKGROUND OF THE INVENTION

Flowable cosmetics are applied by hand or with brushes or rollers. Hand applications may be messy and may leave unwanted residue on hands.

Rolling balls may not provide accuracy of applications and are relatively expensive to manufacturers, requiring multiple part assemblies. Separate brushes and applicator pads add complexities to construction and packaging and are subject to being displaced or lost when needed.

Needs exist for improved cosmetic and skin lotion applicators.

SUMMARY OF THE INVENTION

The present invention provides a unitary applicator formed in a single mold, which in a preferred embodiment is formed with the container so that all that is required is that the cap be closed and that the container be filled and sealed before the product is ready for packaging and shipping. The present invention provides an improved applicator at a reduced cost.

While in preferred embodiments the applicator and container are manufactured together, the applicator head may be manufactured for later attachment to a container, such as by fusing, welding or bonding, or by preconstructed mechanical connectors. However, in the preferred form of the invention the applicator and the container a re formed in a single mold. Preferably the mold has movable parts so that a single shot can form structural parts of the applicator and container, and so that a subsequent shot of softer material may form the applicator surfaces and, when desired, non-slip surfaces on a part of the container that is hand held during applications of the flowable material to skin or other substrates or surfaces. This two-shot construction enables the applicator area to support a more compliant contact surface that flexes and conforms to the force placed upon its surface. The use of non-open cell materials to form the contact surface improves hygiene by reducing contamination of the applicator. The reduction of dead space in the cap allows almost all of the contents to be dispensed.

In preferred embodiments, double hinged caps are connected to the applicator head with living hinges and are formed at the same time that the structure of the applicator head is being formed. Alternatively, the applicator heads may be formed with receivers, and double hinged caps may be formed with connector blades for snapping into the receivers after the applicator heads with the connected container and the caps are separately molded. The double hinges allow the caps to be folded back flush with the rear surfaces of the applicators during direct applications of the materials.

In preferred embodiments of the cap, the cap has flat surfaces which are provided with lenticular lenses to provide multiple images from underlying interlineated multiple graphics. The flat surfaces in one embodiment are formed on the axial ends of the caps. When a cap is closed, the cap, applicator head and container may stand on the cap. In another form, the flat surface with the lenticular lenses overlying multiple images is formed so that it is parallel to the applicator surface when the cap is closed.

The caps and applicator heads have complementary snaps along forward insides of the caps and forward edges of the heads. Alternatively and preferably, the interfitting snaps for holding the caps closed are formed by the extended sides of the cap cooperating with sides of the applicator head.

Material may be flowed from the container through a flow channel out onto the applicator surfaces by squeezing or otherwise compressing the container or by moving the applicator head toward the container. Preferably material flows radially outward in a ring on an annular applicator surface, which is sloped with respect to longitudinal directions of the container.

In a simplified form of the invention, the cap has a plug post which fits within the exit hole of the flow tube, stopping flow when the cap is closed.

A preferred form of the valve is a one-piece compliant structure with a stem which is anchored within the flow tube, leaving flow channels between the outer wall of the stem and the inner wall of the flow tube. The valve has a flat outer surface with a thicker inner part that fits within a recess and a thinner outer flange part which rests against an annular ledge. As pressure of the material within the container is increased by compressing the container or moving the applicator head toward the container, material flows, increasing pressure along the valve stem and in the recesses and flexing the flexible outer flange of the valve face away from the ledge on which is rests, allowing material to flow radially outward in a ring over the annular applicator surface.

These and further and other objects and features of the invention are apparent in the disclosure, which includes the above and ongoing written specification, with the drawings.

BRIEF DESCRIPTION OF THE DRAWINGS

FIG. 7 shows a snap in a free end of the cap.

DETAILED DESCRIPTION OF THE PREFERRED EMBODIMENTS

Figure 1:
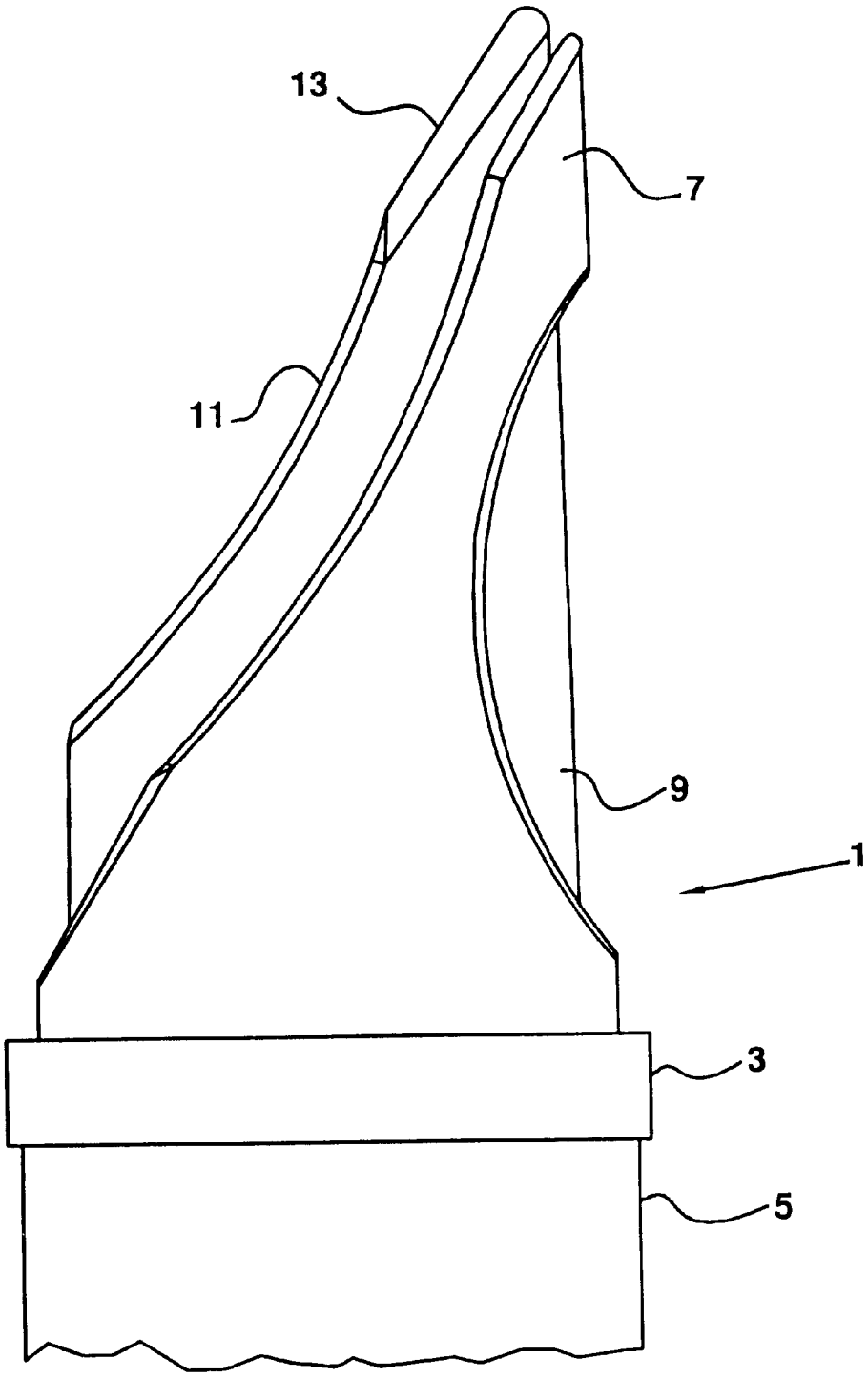
FIG. 1 is a side elevation of a lip applicator.

FIG. 1 shows an applicator top 1 with a neck 3 which connects with a container body 5. The applicator top has a wall 7 with a thinner section 9, which allows the user to flex the area inward, pushing a portion of the contents out of the container. The contact surface 11 of a lip applicator may be constructed with a one-piece or two-shot construction so that the actual raised lip-contacting surface 13 may be constructed of a compliant material.

Figure 2:
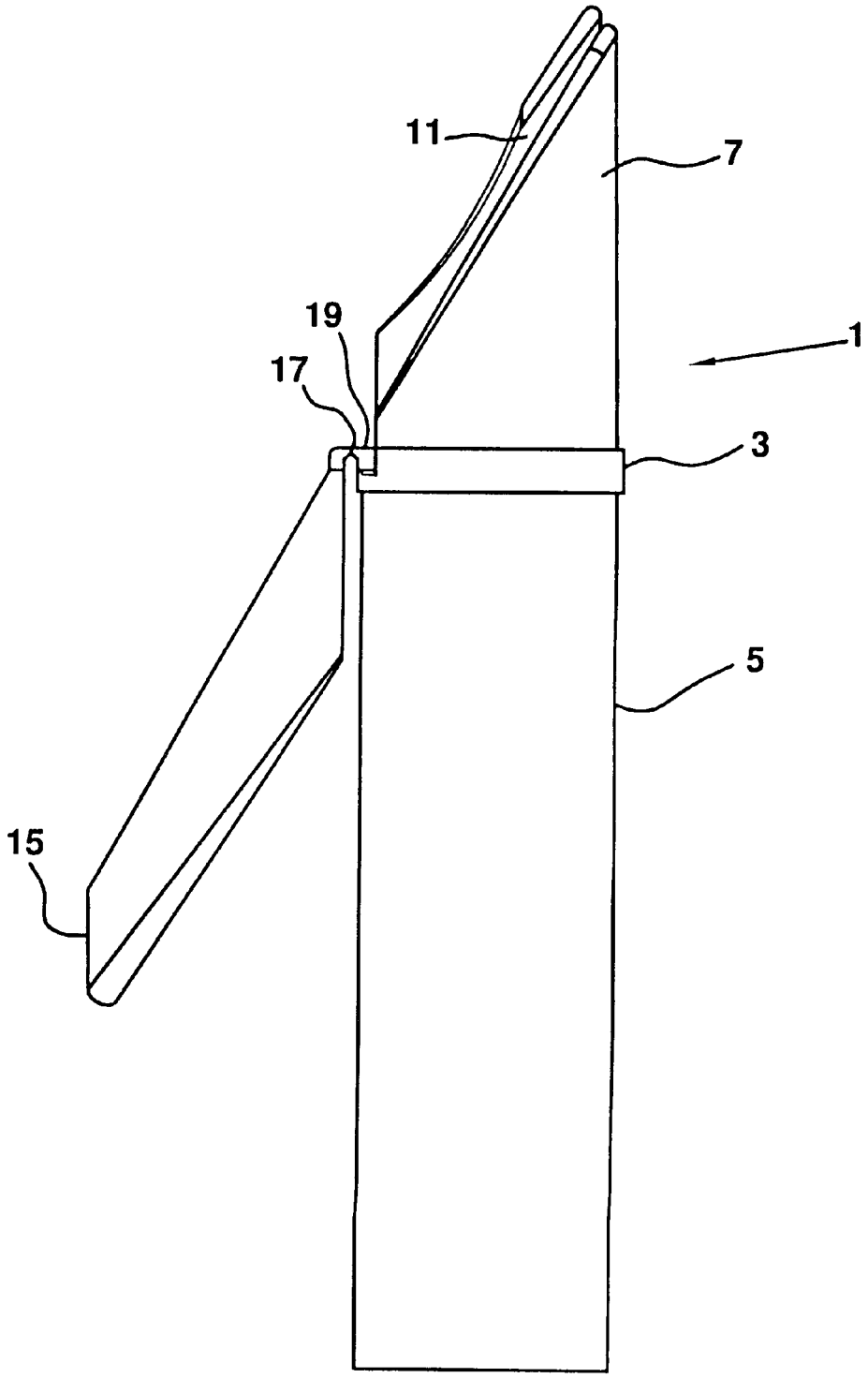
FIG. 2 is a side elevation of a lip applicator and container body showing a molded hinged cover.

FIG. 2 shows the structure of FIG. 1 with a cap 15 formed on a living hinge 17 on an extension 19 from the applicator top 1.

Figure 3:
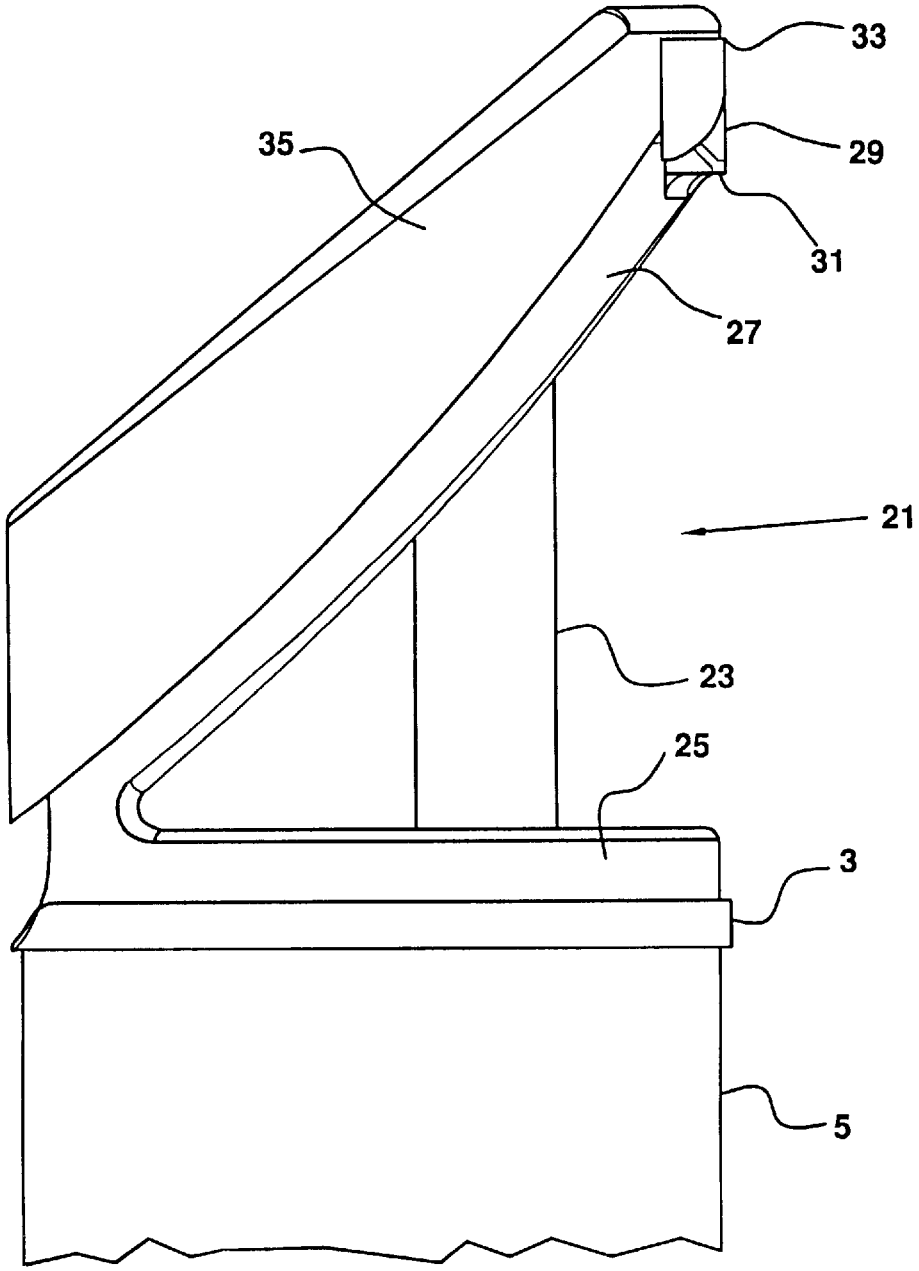
FIG. 3 is a side elevational detail of an alternate cap and body.

In an alternate form of applicator top 21 shown in FIG. 3, a flow channel 23 is exposed between a base 25 and a sloping wall 27. At the top of the sloping wall 27 a double hinge spacer 29 with two living hinges 31 and 33 supports a cap 53, which covers the applicator surface.

Figure 4:
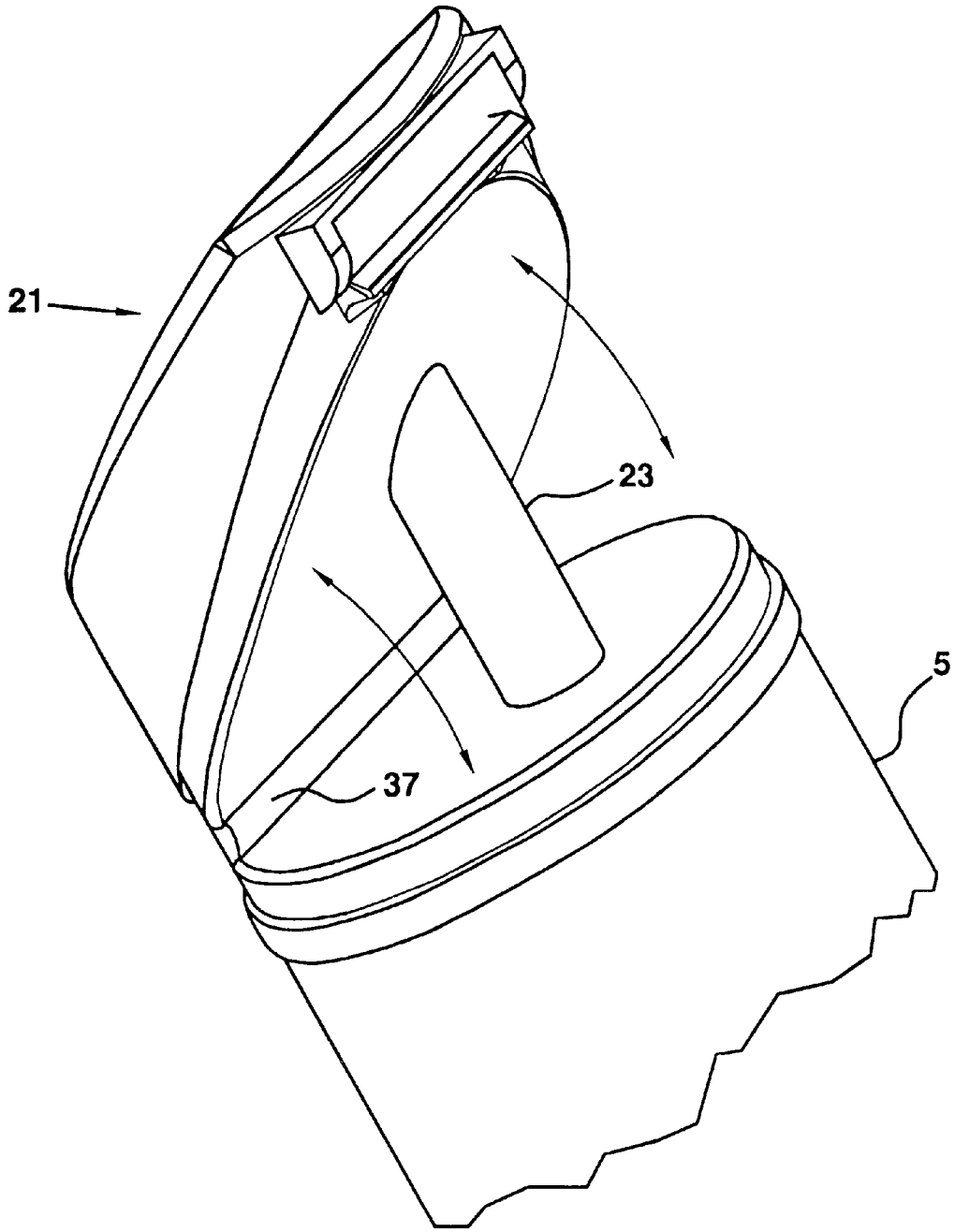
FIG. 4 is a perspective view of the applicator shown in FIG. 3.

As shown in FIG. 4, when the head 21 is flexed, the contents of the body 5 are squeezed outward through hollow channel 23 to spread across the applicator. A flexing area 37 allows the downward flexing of the head 21.

Figure 5:
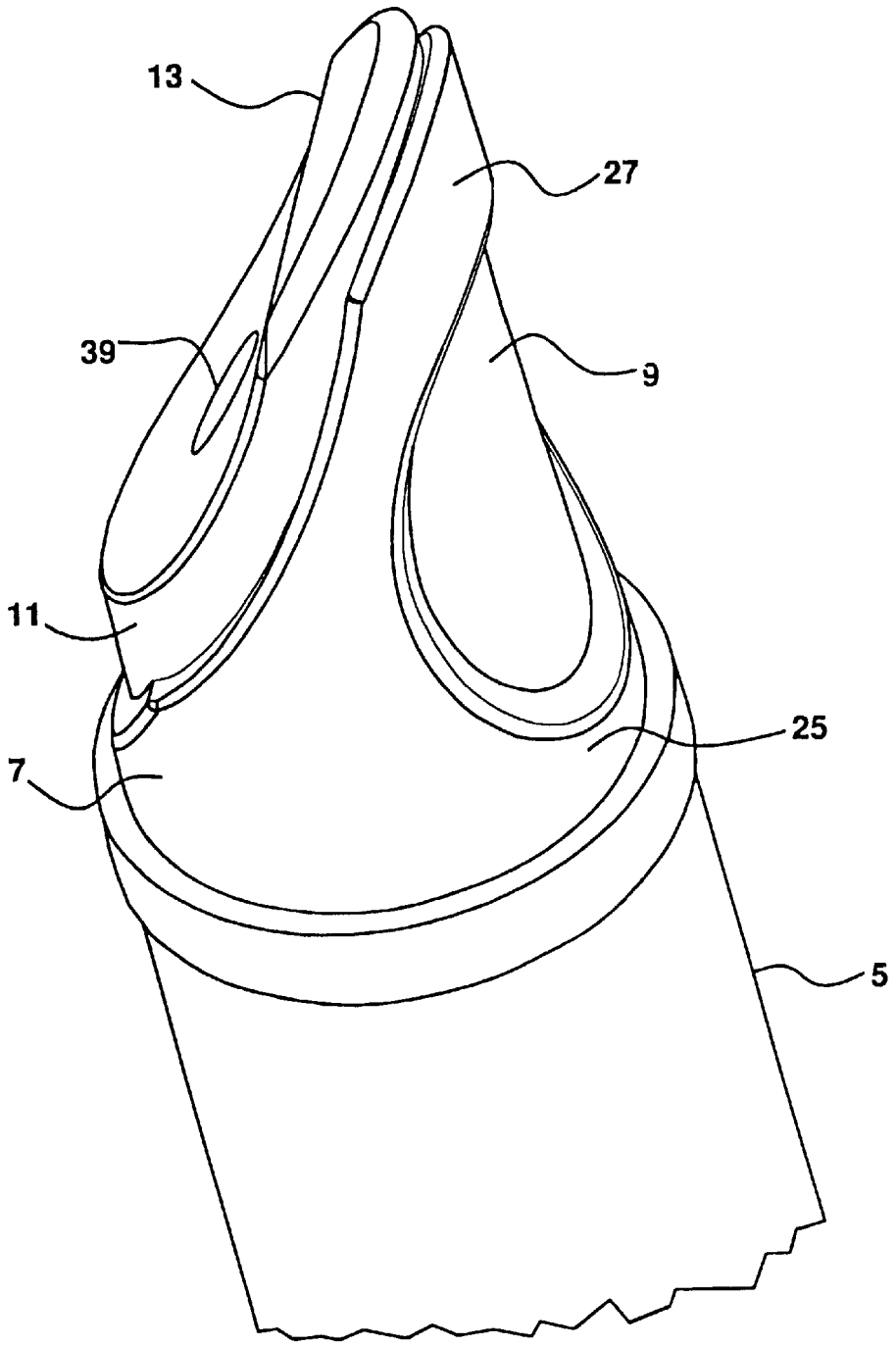
FIG. 5 is a perspective view of an applicator showing an open hinged cap, a compliant annular applicator surface and a compliant valve for dispensing contents as a ring.

As shown in FIG. 5, the base 25 and sloping wall 27 may be enlarged into a wall 7 similar to that shown in FIG. 1, with the flex area 37 sufficient to flex when pressure is placed on the applicator 11 or applicator pad 13. A central opening 39 allows the contents of the body to spread radially outwardly across the annular applicator.

Figure 6:
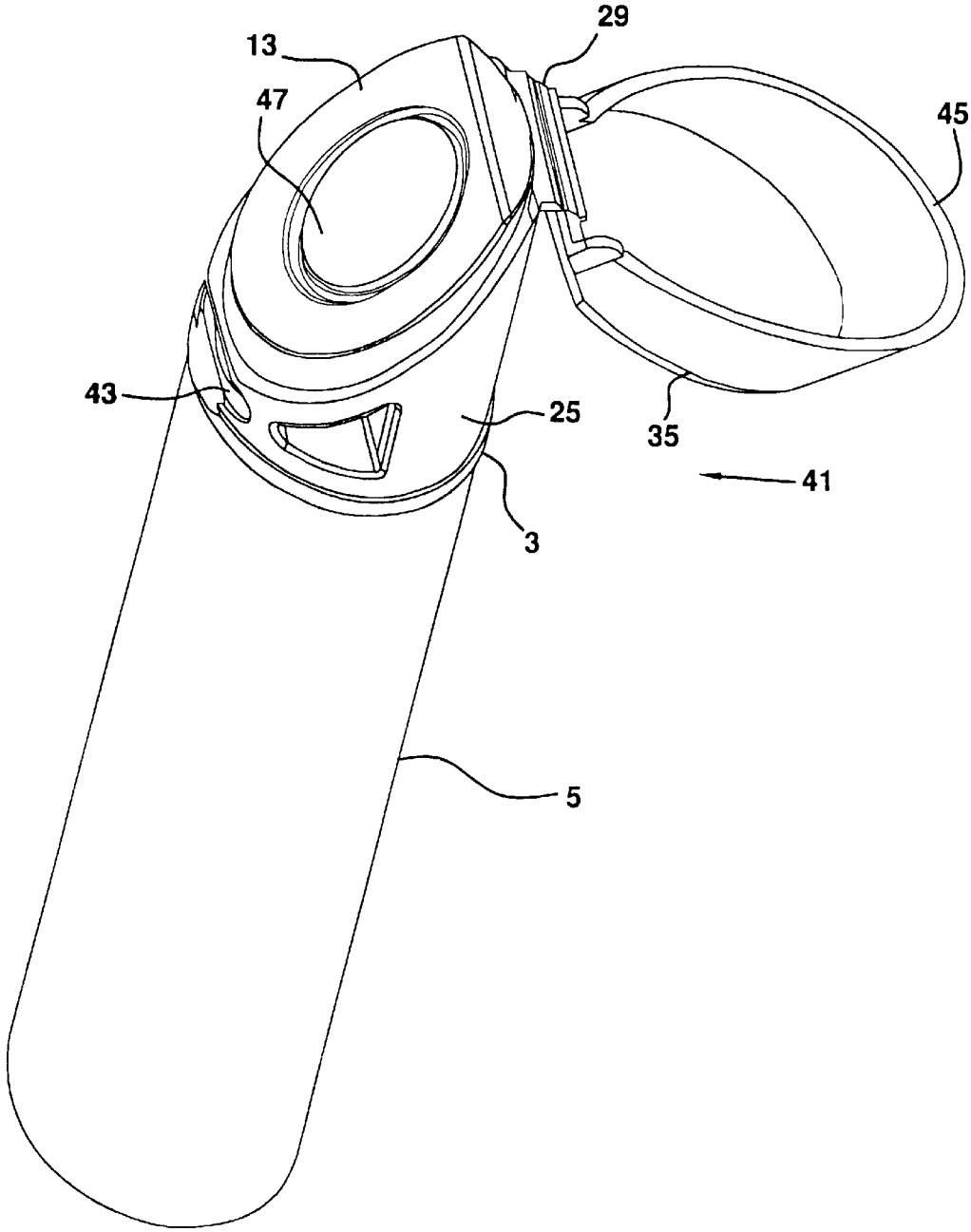
FIGS. 6 & 7 are perspective views before closing a cap and filling an integrally formed body.

In FIG. 6 the head 41 has a cap 53 mounted on a double hinge 29. The base 25 has a snap 43 which may either be a recess as shown or a projection which cooperates with a projection or recess on the free end 45 of the cap 53. A large central valve 47 within the annular applicator surface 13 radially supplies materials from the body 5 to the annular applicator surface 13.

Figure 7:
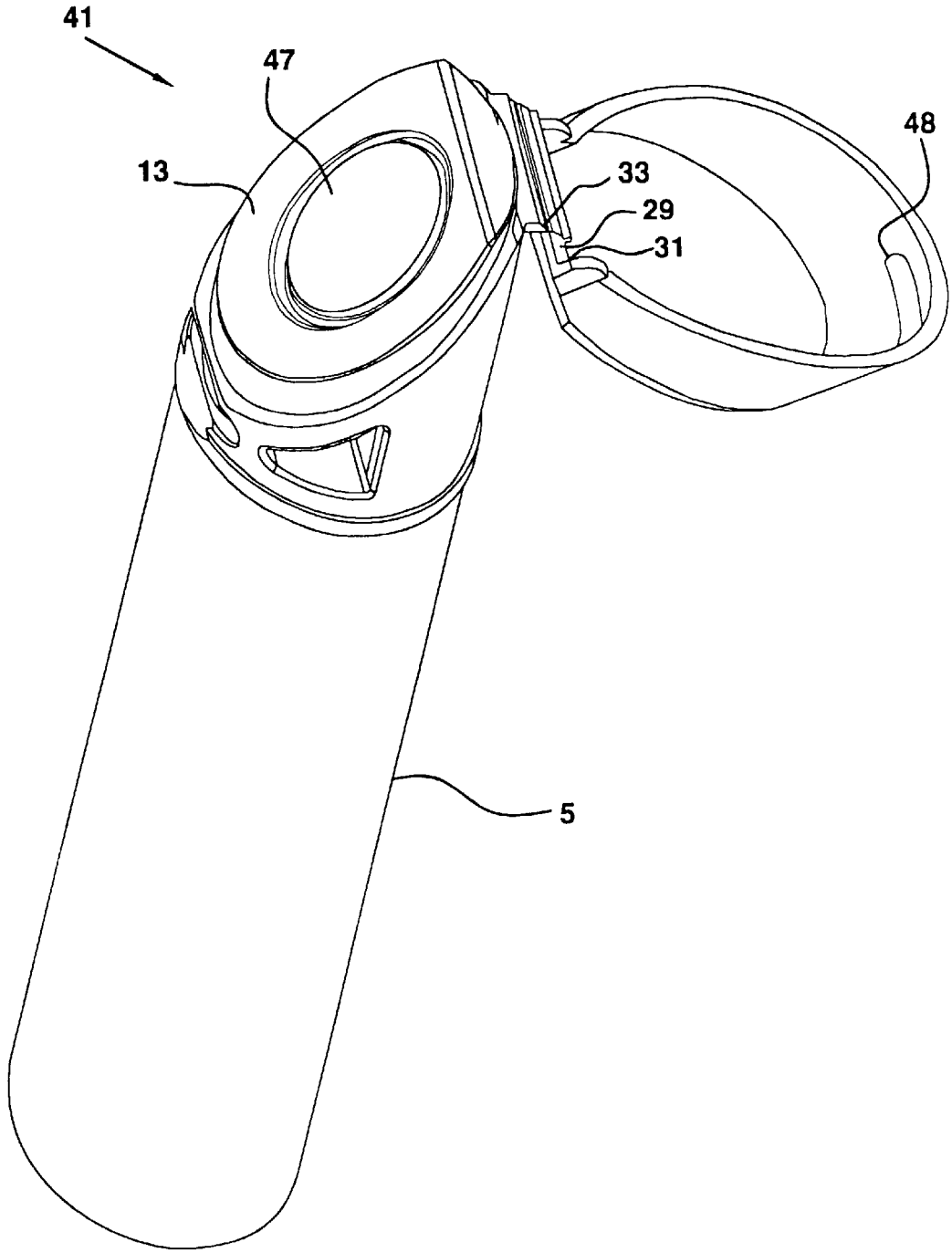

A preferred projecting complementary snap 48, which cooperates with the recess 43, is shown in FIG. 7. The double hinge 29 has two living hinges 31 and 33. The valve 47 is a compliant valve that dispenses the contents of the container 5 as a ring on the compliant annular applicator surface 13.

Figure 8:
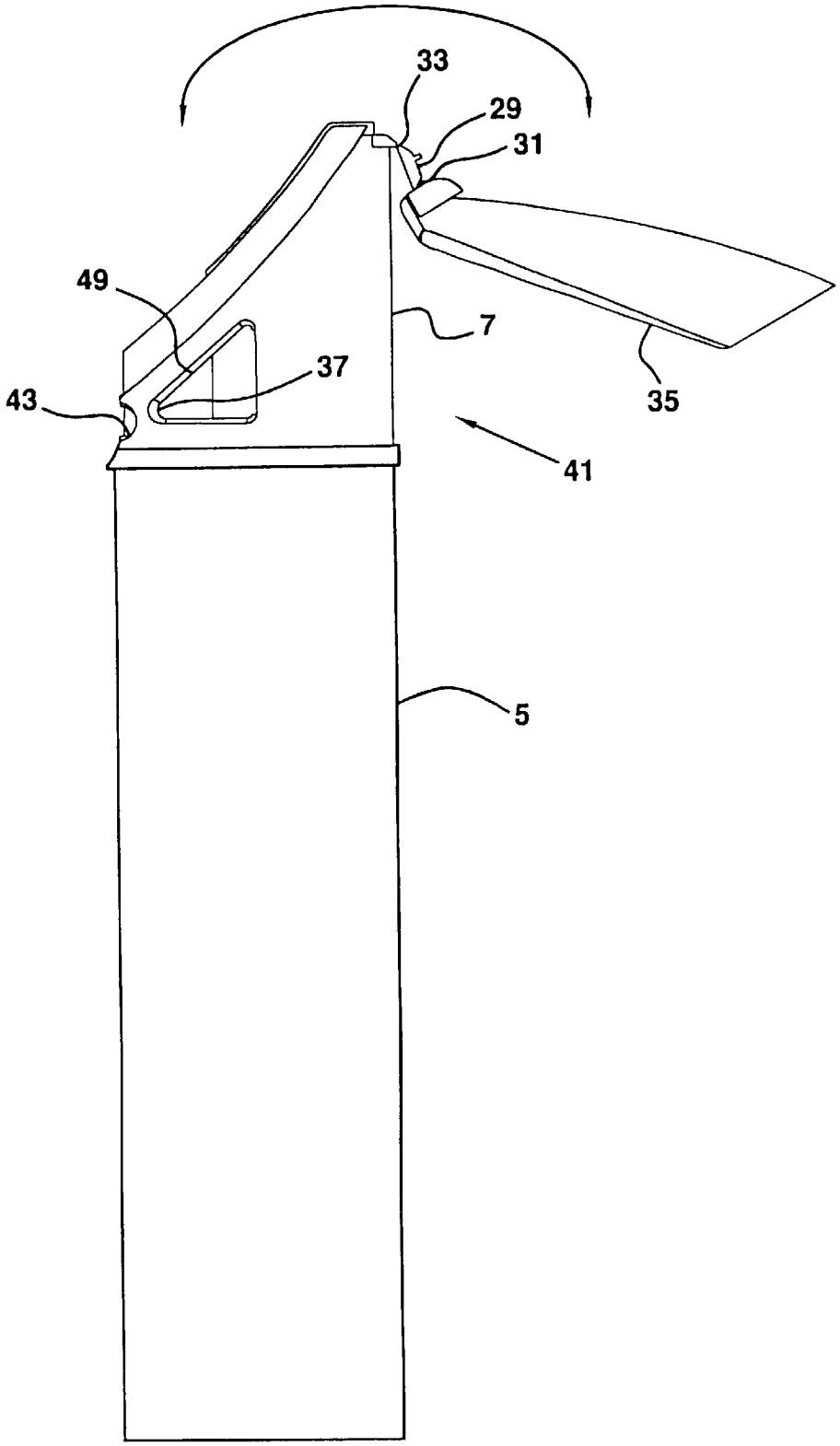
FIG. 8 is a side elevation of the container and applicator shown in FIG. 7.
Figure 9:
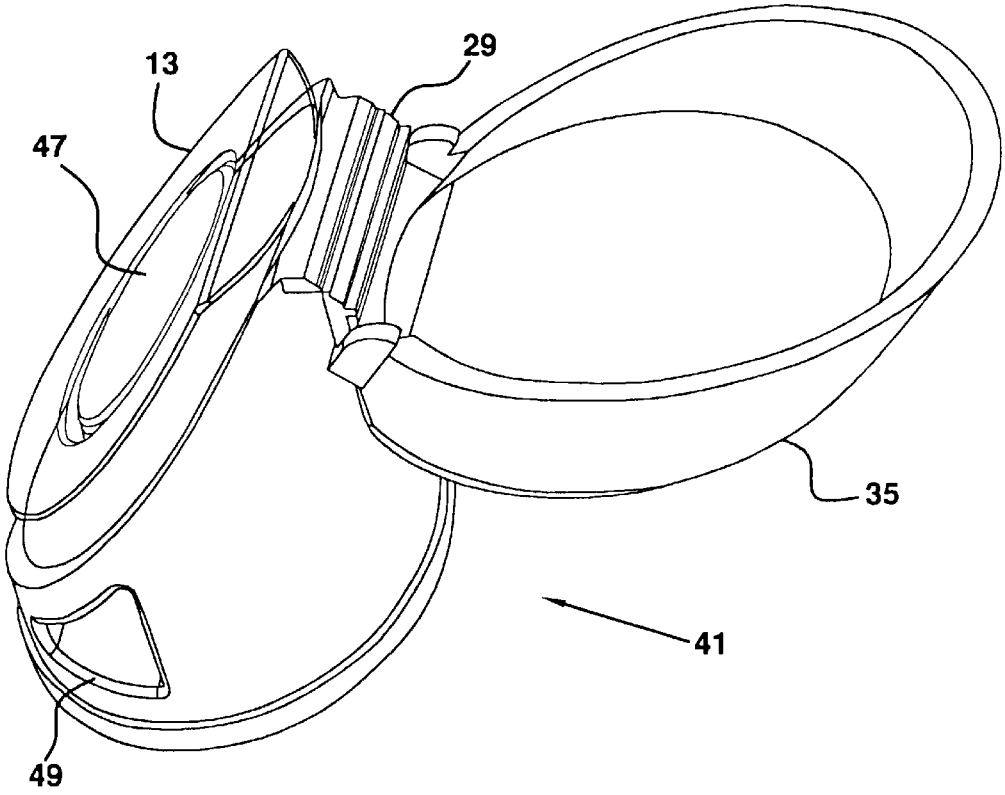
FIG. 9 is a perspective view of an applicator and cap as shown in FIGS. 7 and 8.

FIG. 8 shows a side view of the applicator head 41, showing how the cap 53 is attached to the wall 7 with the double hinge 29. Windows 49 promote the flexibility of the wall and allow molding of the flexing area 37. FIG. 9 is an enlarged detail of the dispenser head.

Figure 10:
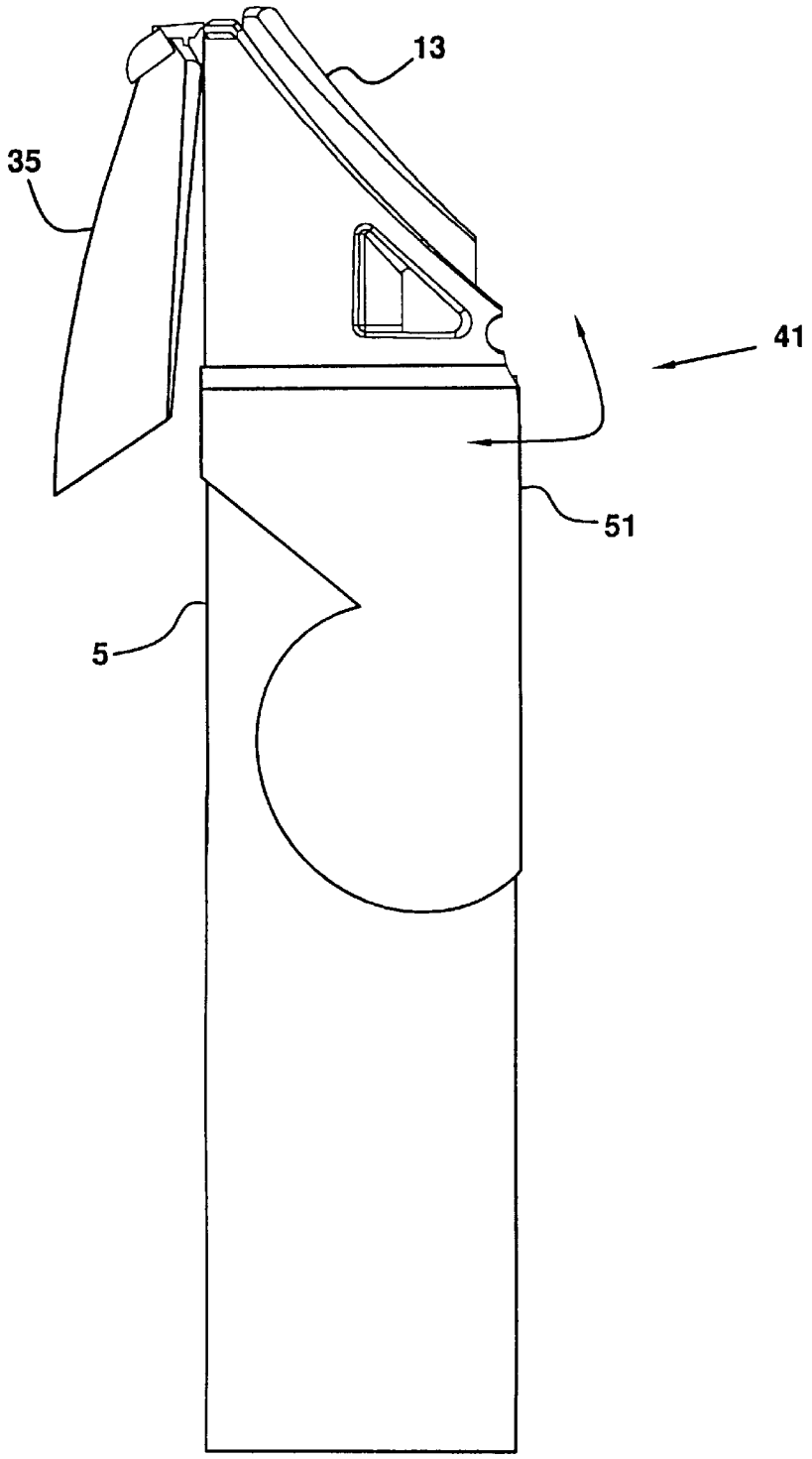
FIG. 10 is a view of the applicator with the cap in a use position and showing a compliant material molded over structural material.

FIG. 10 shows the cap 53 folded downward against the head 41 and container 5 as it would be when the applicator surface 13 is in use. The compliant material which is molded on structural material in the applicator 13 also is flowed downward 50 over the top of the container 5 to provide a non-slip surface.

Figure 11:
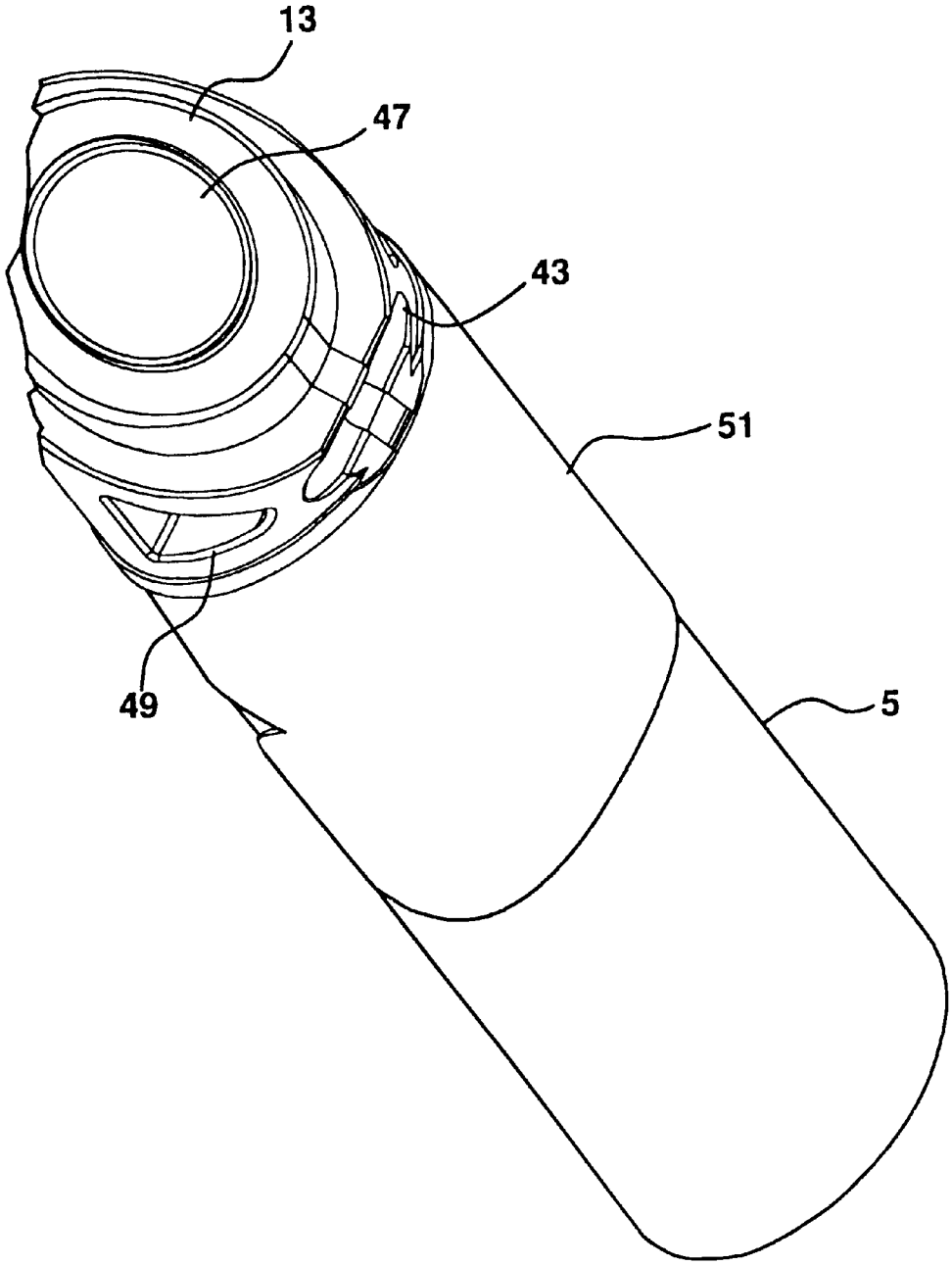
FIG. 11 is a perspective detail showing the applicator top and compliant material which extends over the body as a non-slip surface.
Figure 12:
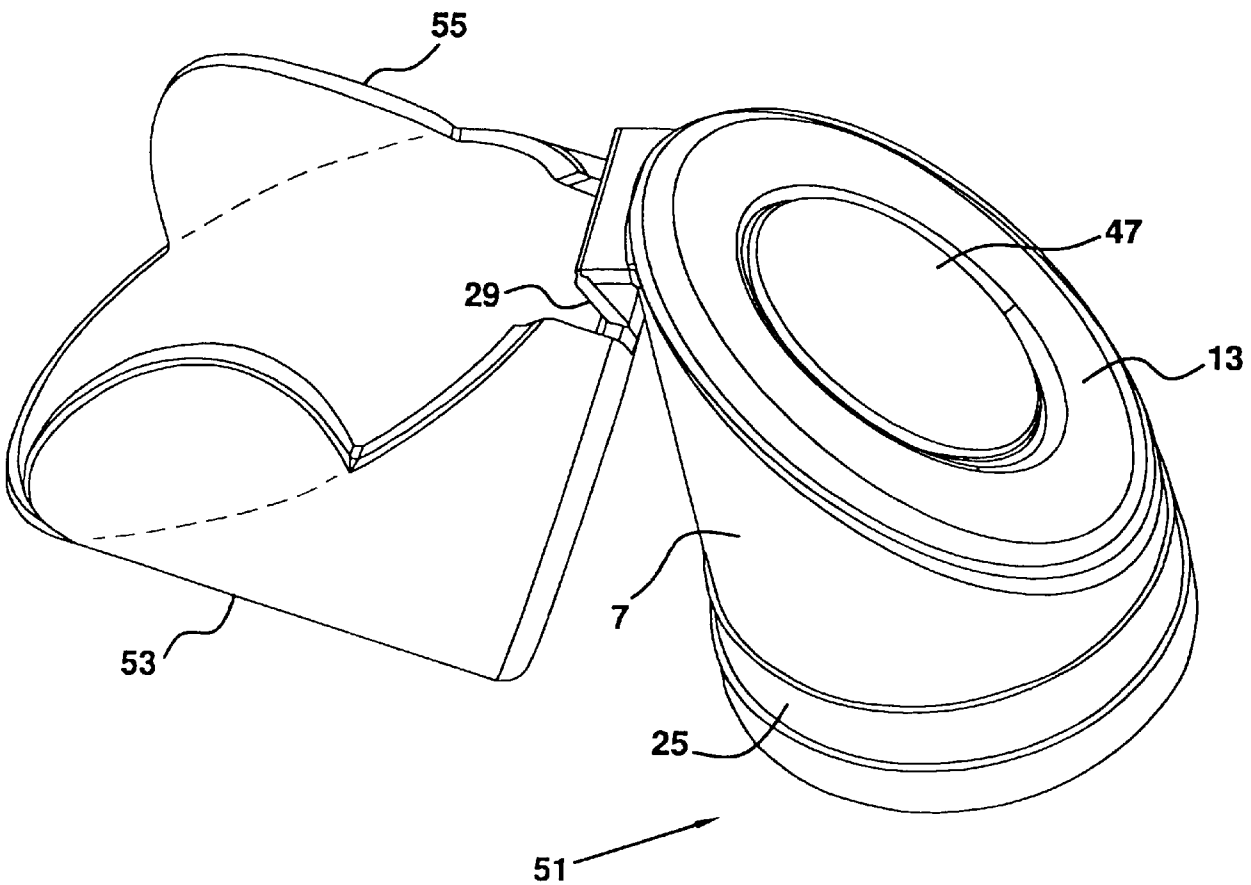
FIG. 12 is a perspective view of an applicator top with a hinged cap having side clasps.

As shown in FIG. 11, the compliant surface on the applicator 13 extends onto the body 5 as a non-slip surface. An applicator head 51 with a modified cap 53 is shown in FIG. 10.

The cap has a base 25, a wall 7 and a valve 47 which flows the material over the annular compliant applicator surface 13, the same as the other applicator heads. Cap 53 has clasps 55 which are inwardly curved and which grip the wall 7, holding the cap closed. The double hinge attachment 29 is identical.

Figure 13:
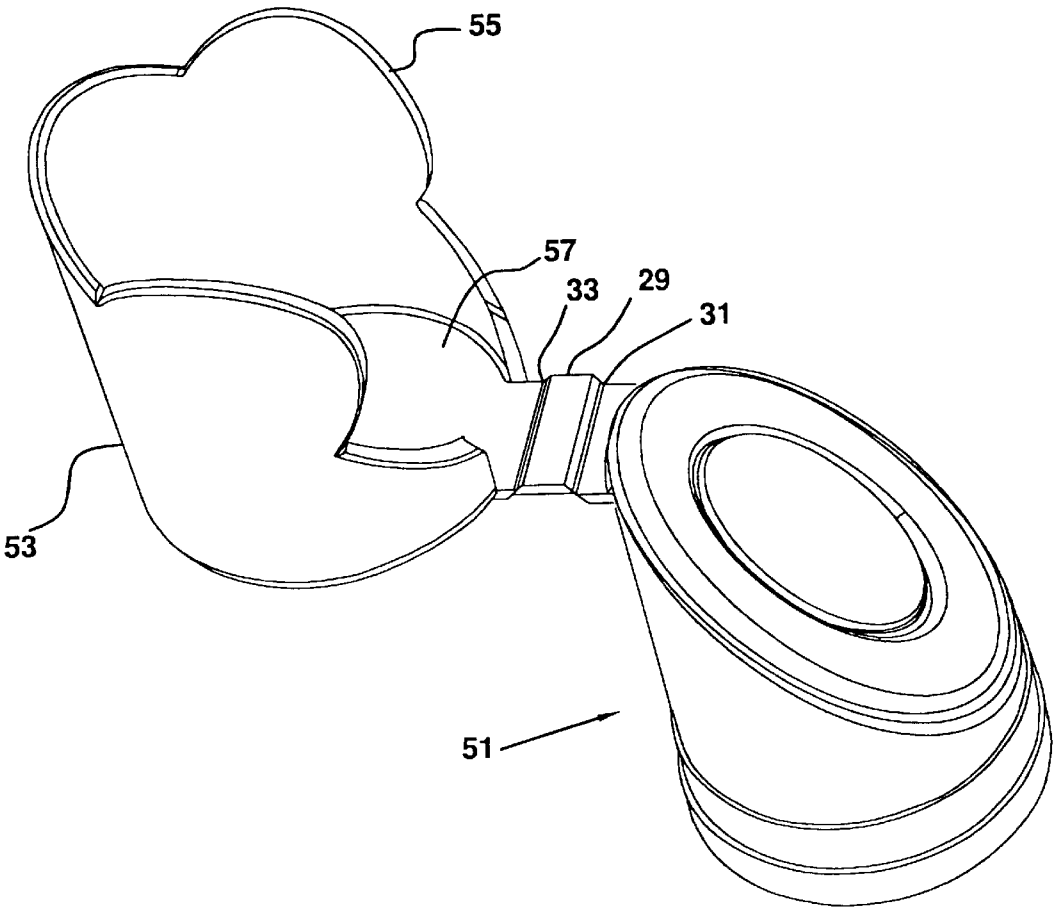
FIG. 13 is a perspective detail of the applicator top shown in FIG. 12 in the molded position.

In the molded position of the cap 53 and applicator head 51, as shown in FIG. 13, the double hinge 29 is horizontal, as is the top 57 of the cap. The clasps 55 are molded in a continuation of the cylindrical surface of the cap 53.

Figure 14:
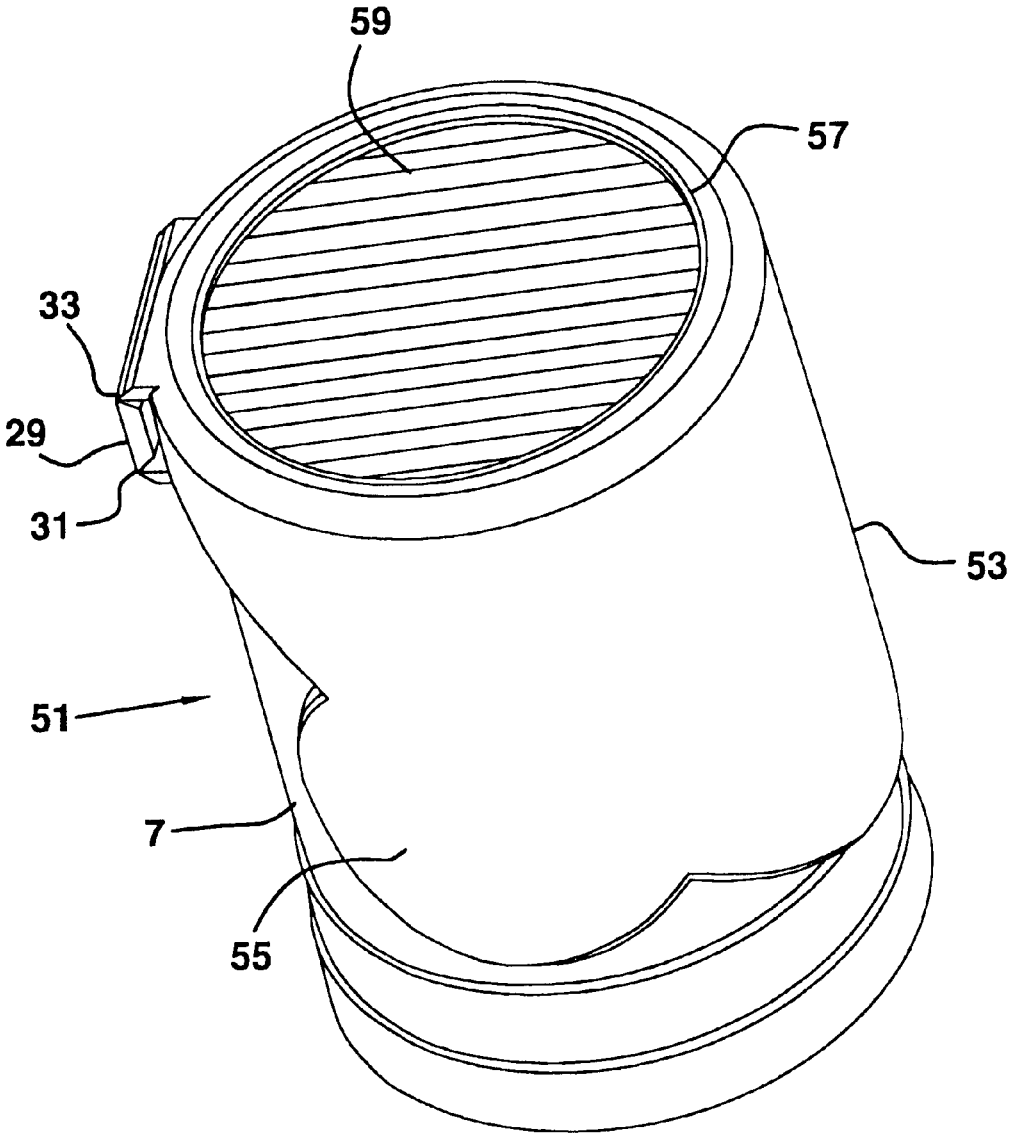
FIG. 14 is a perspective detail of the applicator top shown in FIGS. 12 and 13 with the cap in closed position. The flat upper surface provides a lenticular lens multiple image graphics viewing.

As shown in FIG. 14, the flat top 57 provides an area for lenticular lenses 59 to selectively reveal multiple image graphics below the lenticular lens 59.

As shown in FIG. 14, the cylindrical clasp wings 55 grip the cylindrical wall 7, holding the cap 53 closed.

Figure 15:
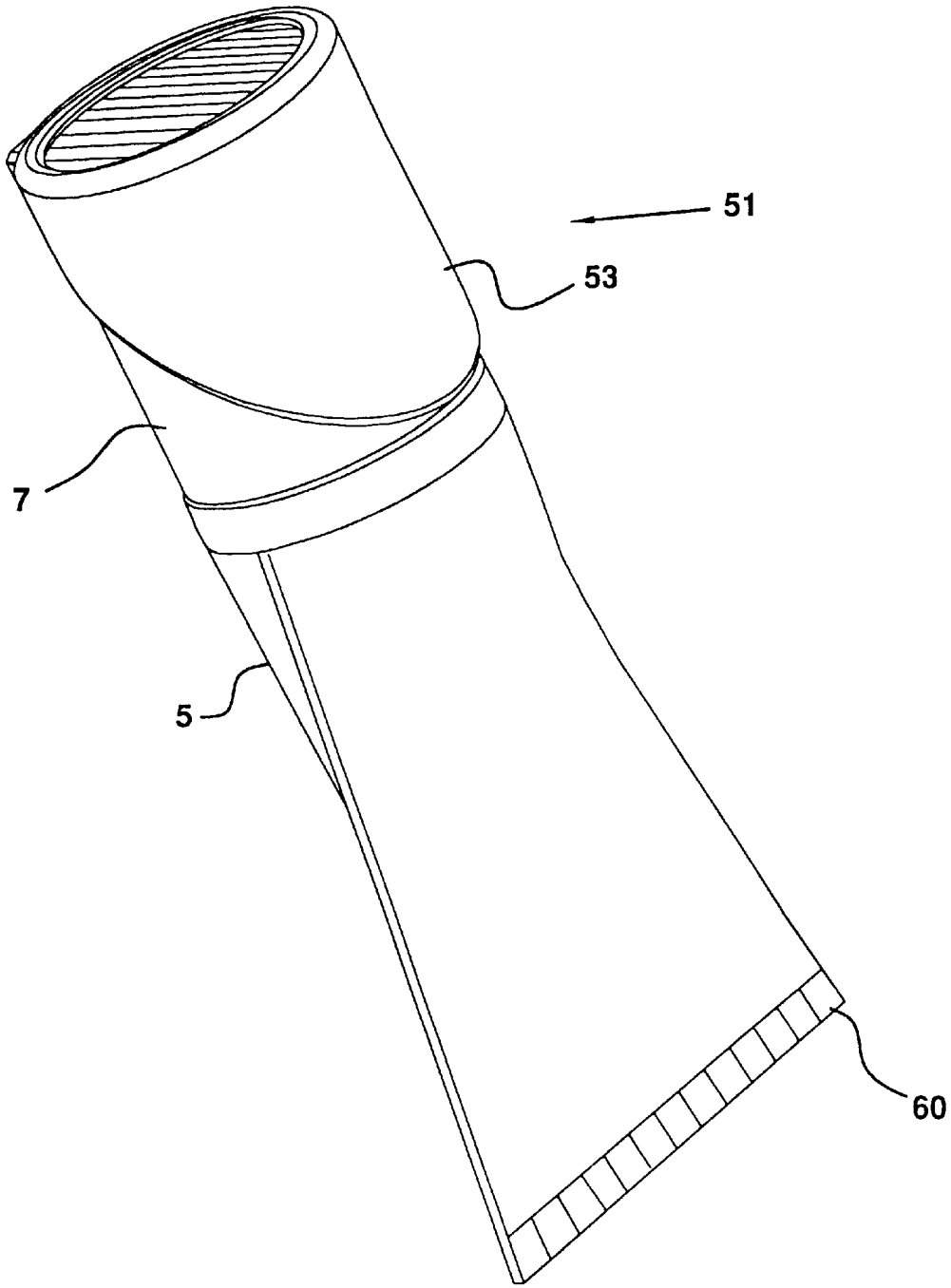
FIG. 15 is a view of an applicator top on a tube body.

As shown in FIG. 15, the cap 53 is closed on the wall 7 of the applicator head 51. The lower end 60 of the body 5 is crimped and sealed after the body has been filled with the contents.

Figure 16:
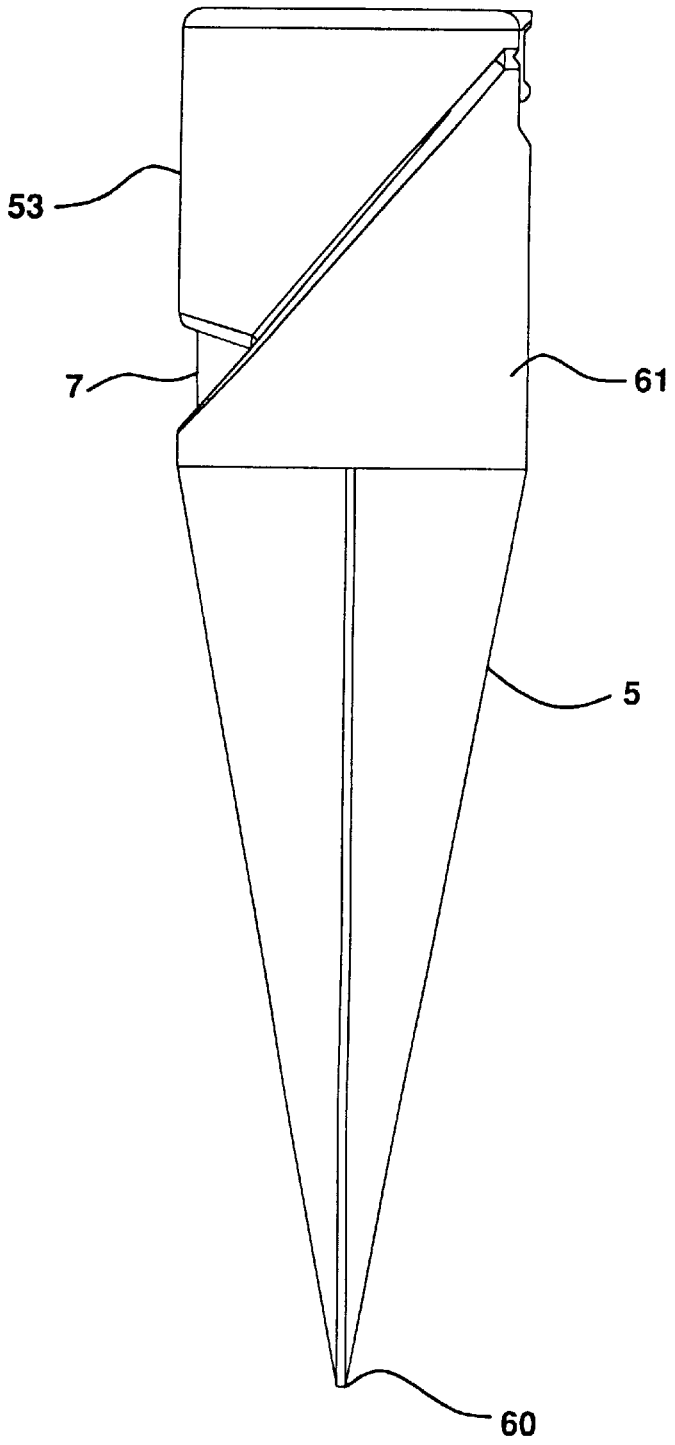
FIG. 16 is a side elevational view of an applicator top showing details of the hinged area.

FIG. 16 shows the cap 53 closed on the cylindrical surface 7. The applicator head 61 is enlarged to cylindrically align with the cap 53.

Figure 17:
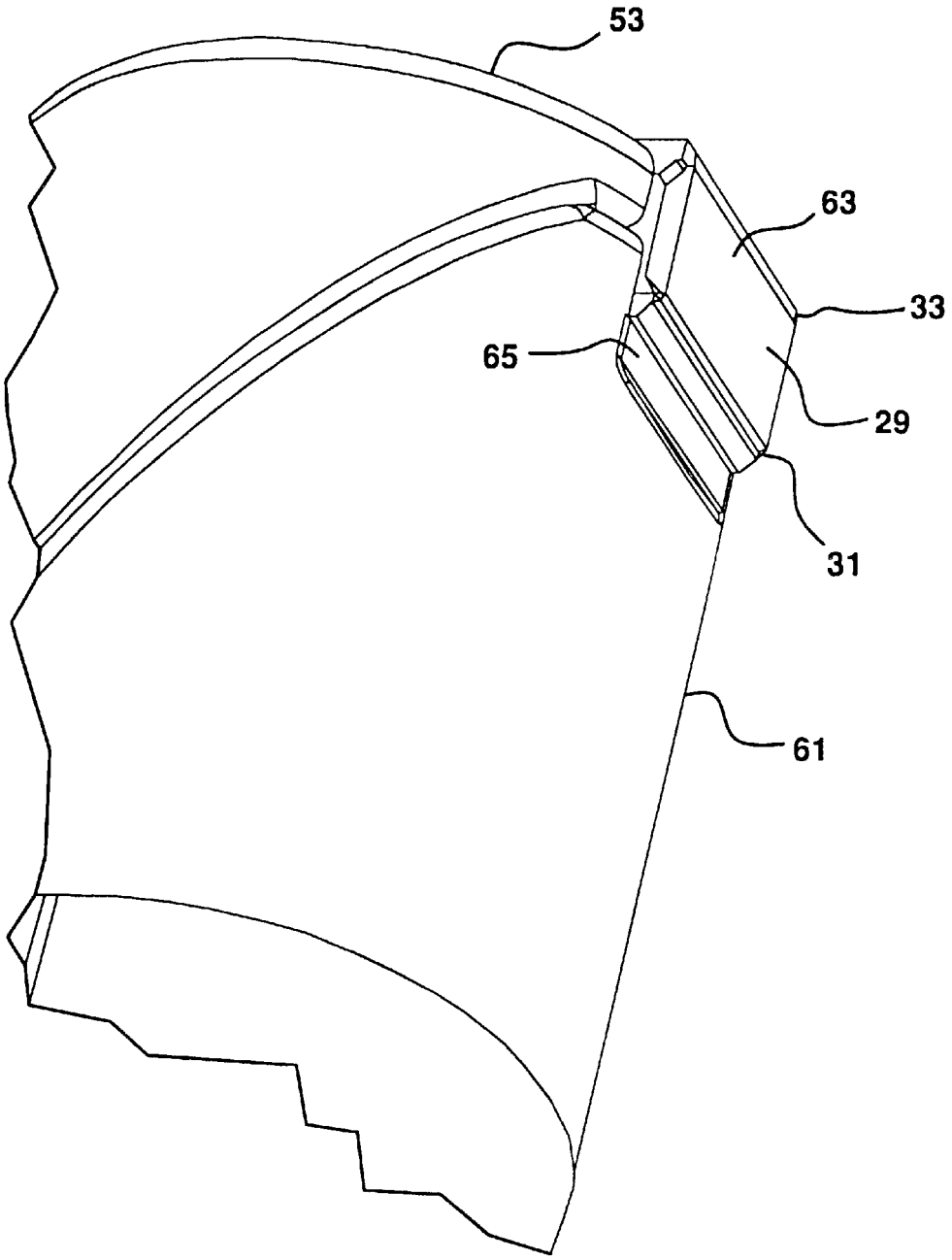
FIG. 17 is a perspective detail of the hinge area of the top shown in FIG. 16.

As shown in detail of FIG. 17, the double hinge 29 allows the cap 53 to swing rearward. The lower living hinge 31 allows the center zone 63 of the double hinge 29 to fold within the relieved area 65 so that the center zone lies along the cap neck 61.

Figure 18:
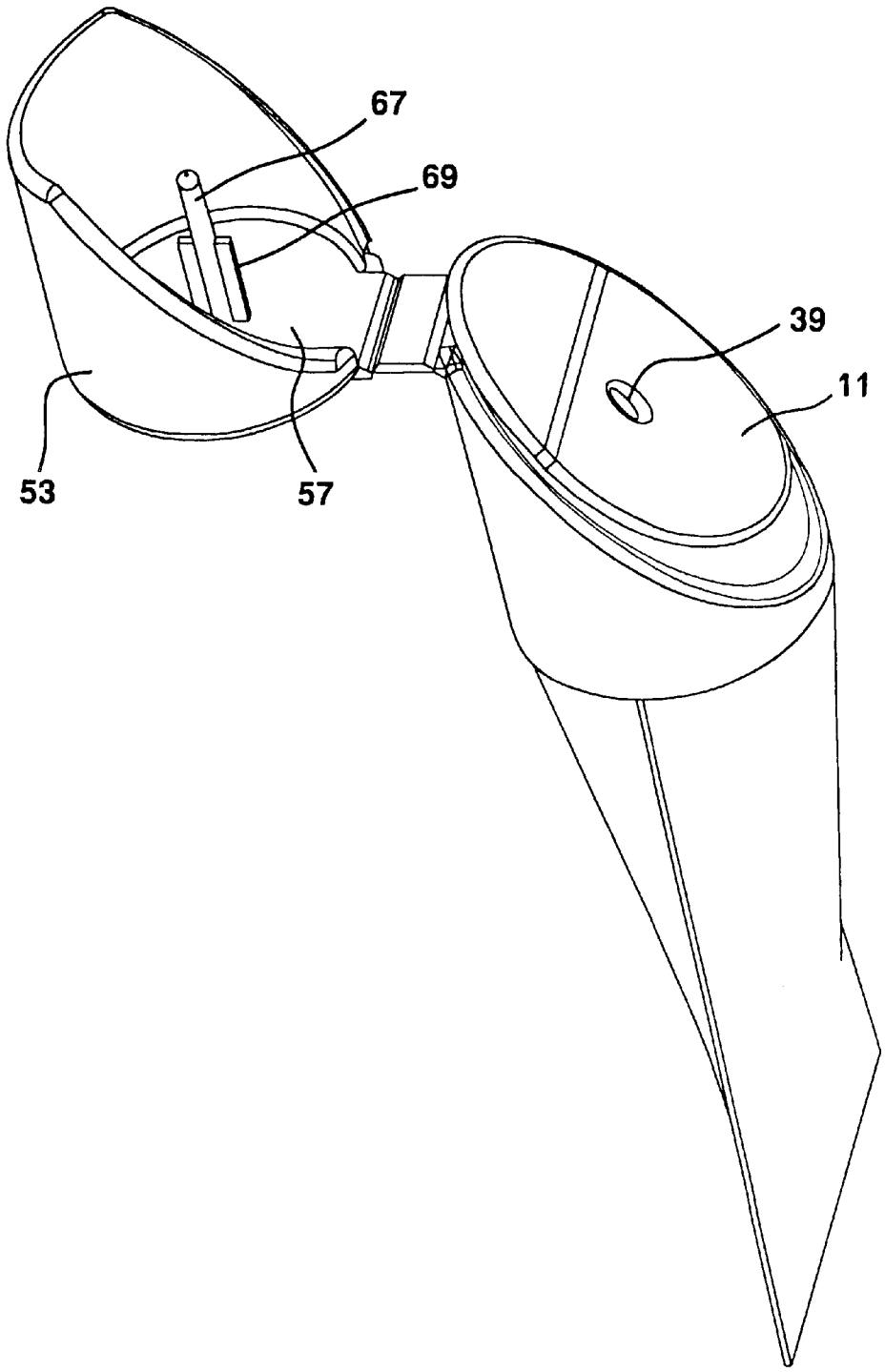
FIG. 18 shows an open applicator top of the type shown in FIGS. 16 and 17 showing a plug post to close a central exit hole in the applicator top.
Figure 19:
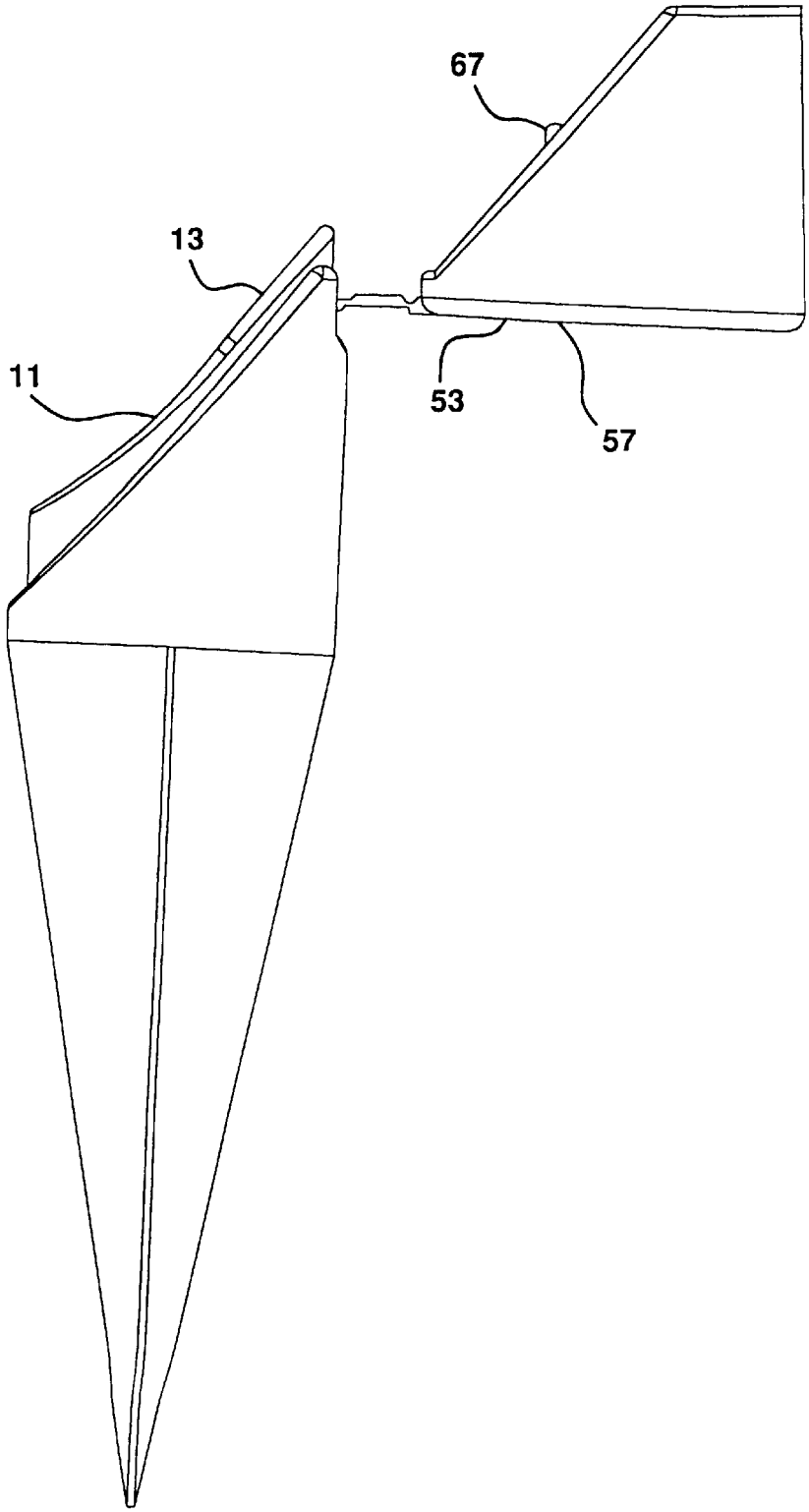
FIG. 19 is a side detail showing the hinge in molded position.

As shown in FIG. 18, a plug post 67 with reinforcement 69 is formed on the inside of top 57 of the cap 53 to plug the exit hole 39 in the center of the annular applicator surface 11. FIGS. 18 and 19 show the cap 53 and the post 67 in the molded position.

Figure 20:
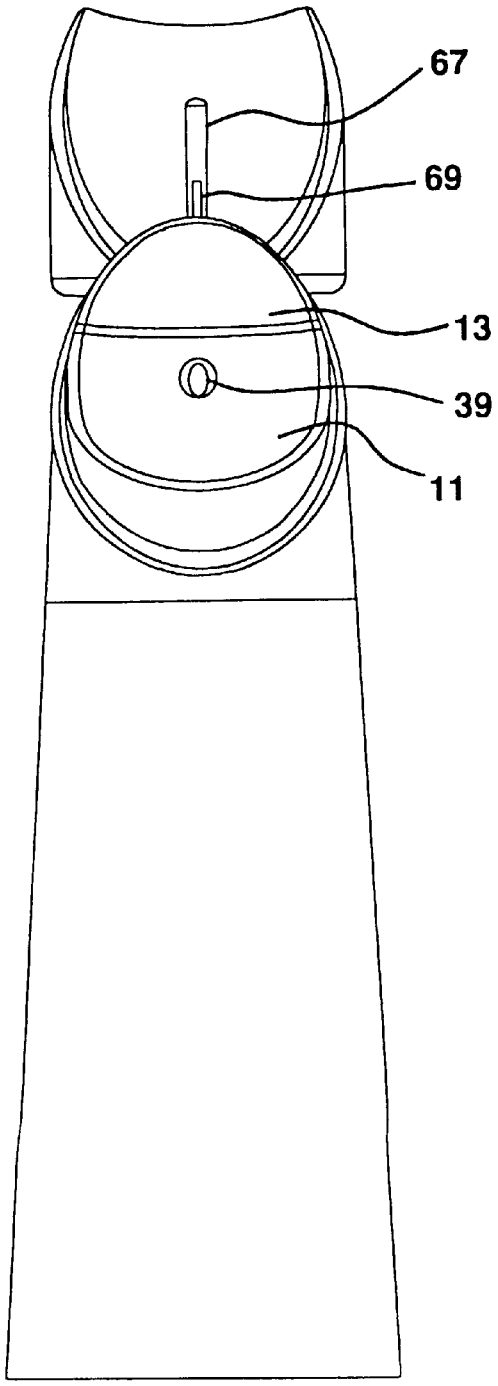
FIG. 20 is a side view showing the body and applicator top.

The front view shown in FIG. 20 shows the alignment of the plug post 67 with the product release opening 39.

Figure 21:
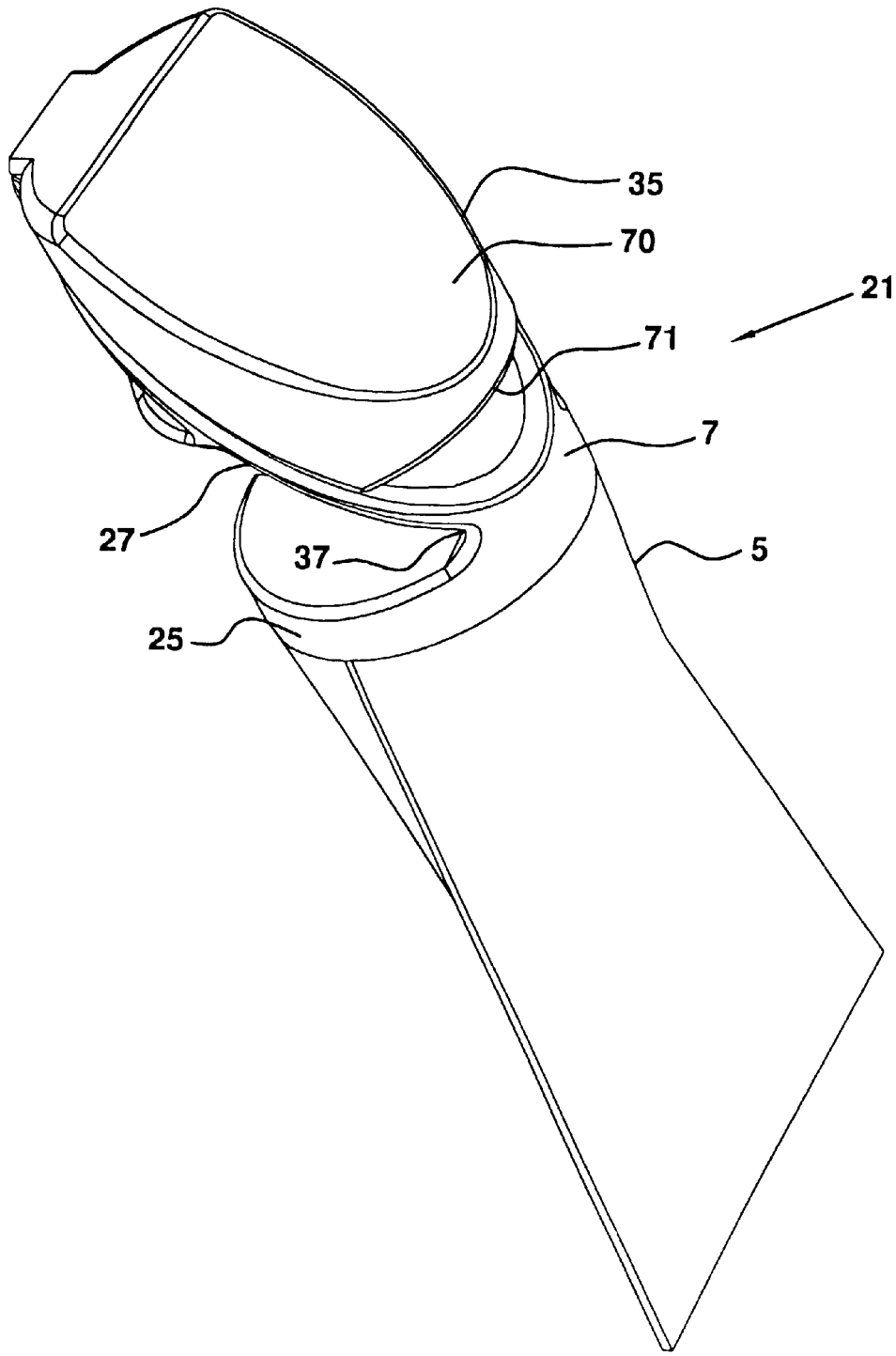
FIG. 21 is a perspective view of a closed applicator top.

FIG. 21 shows an applicator head 21 with a modified cap 35, which has a flat top 70 on which lenticular lenses may be mounted parallel to the applicator surface. The wall 7 has base 25 and upper wall 27 portion. The end 71 of the cap is shortened to provide easy lifting of the cap.

FIGS. 22–43 show caps with connector blades 73. The cap necks 7 are provided with receivers 75 which receive the blades in snap-in condition. The connector blades 73 are connected to the living hinges 31, which are part of the double hinge 29

Figure 22:
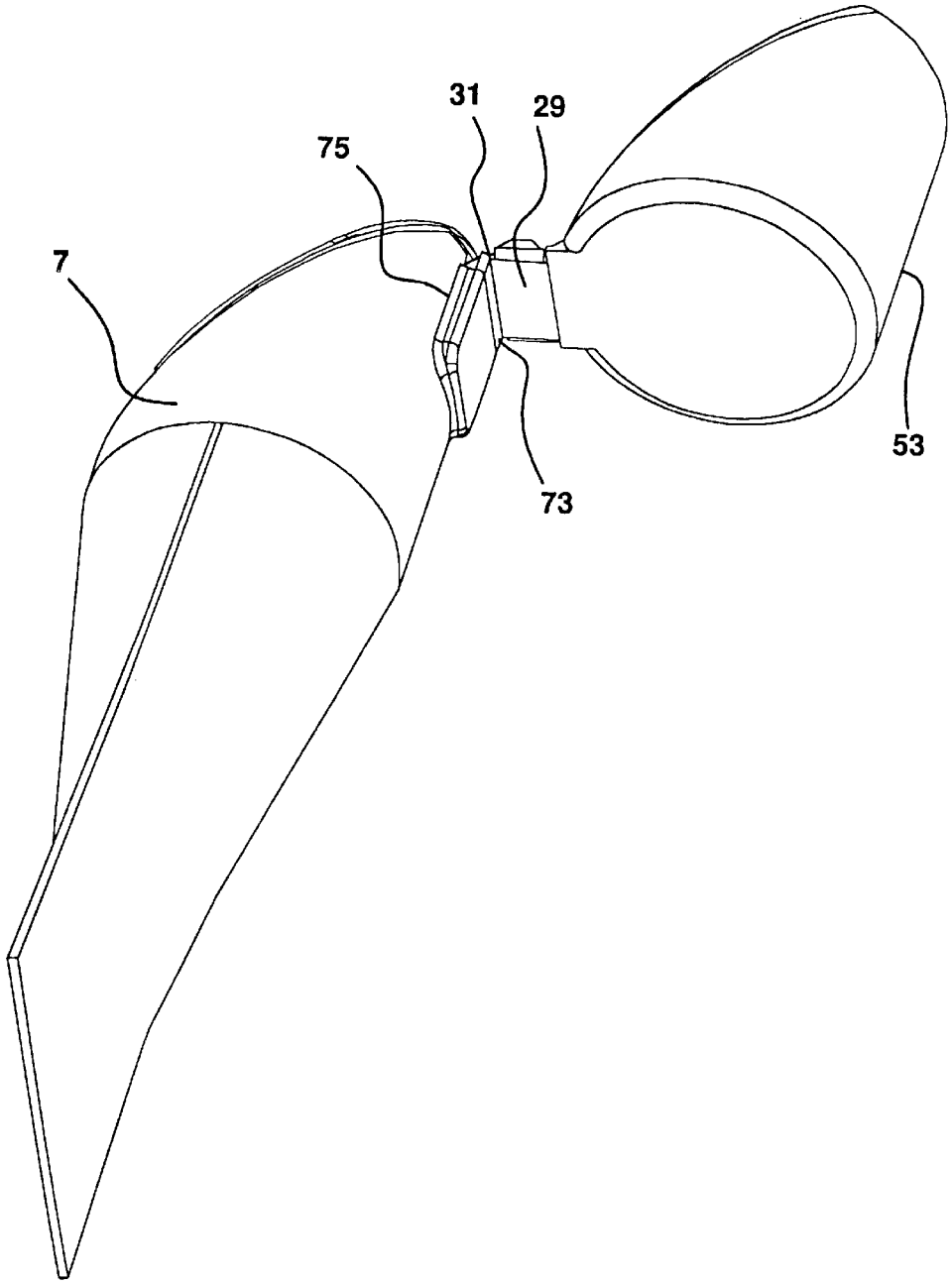
FIG. 22 is a bottom perspective view of the applicator top with a cap in the molded position.

FIG. 22 shows a cap 53 mounted with a connector blade 73.

Figure 23:
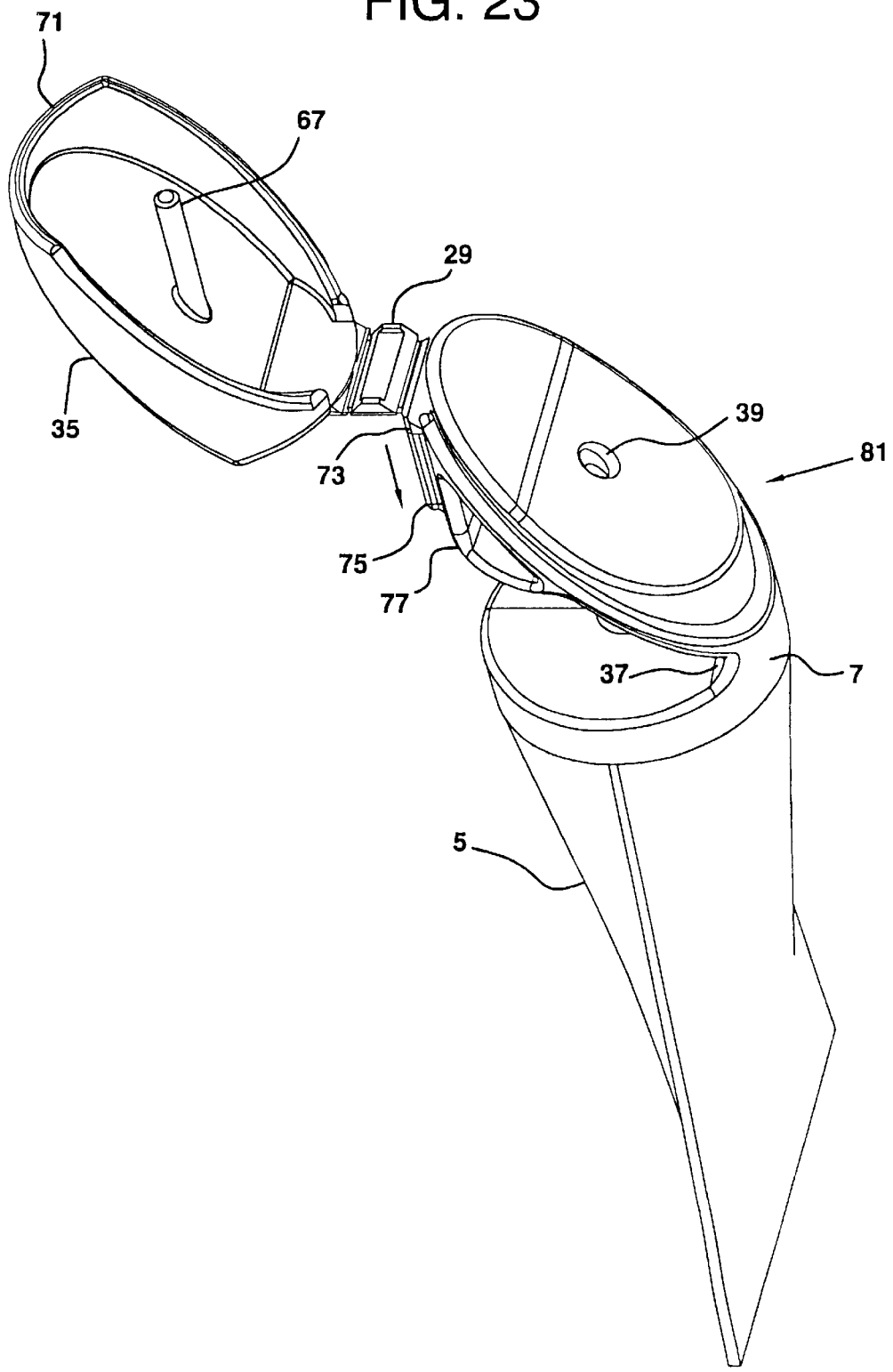
FIG. 23 is a perspective view of the applicator top shown in FIG. 21 with the cap in the open molded position.

FIG. 23 shows a cap 35 molded with a connector blade 73 for fitting within a recess 75 on a rearward extension at the rear of dispenser head 81, which is similar to the dispenser head 21 shown in FIGS. 3 and 4. The flex area 37 permits flexing the end 81 to cause material to flow from opening 39. The extension 77 at the rear of the cap prevents overflexing of the cap.

Figure 24:
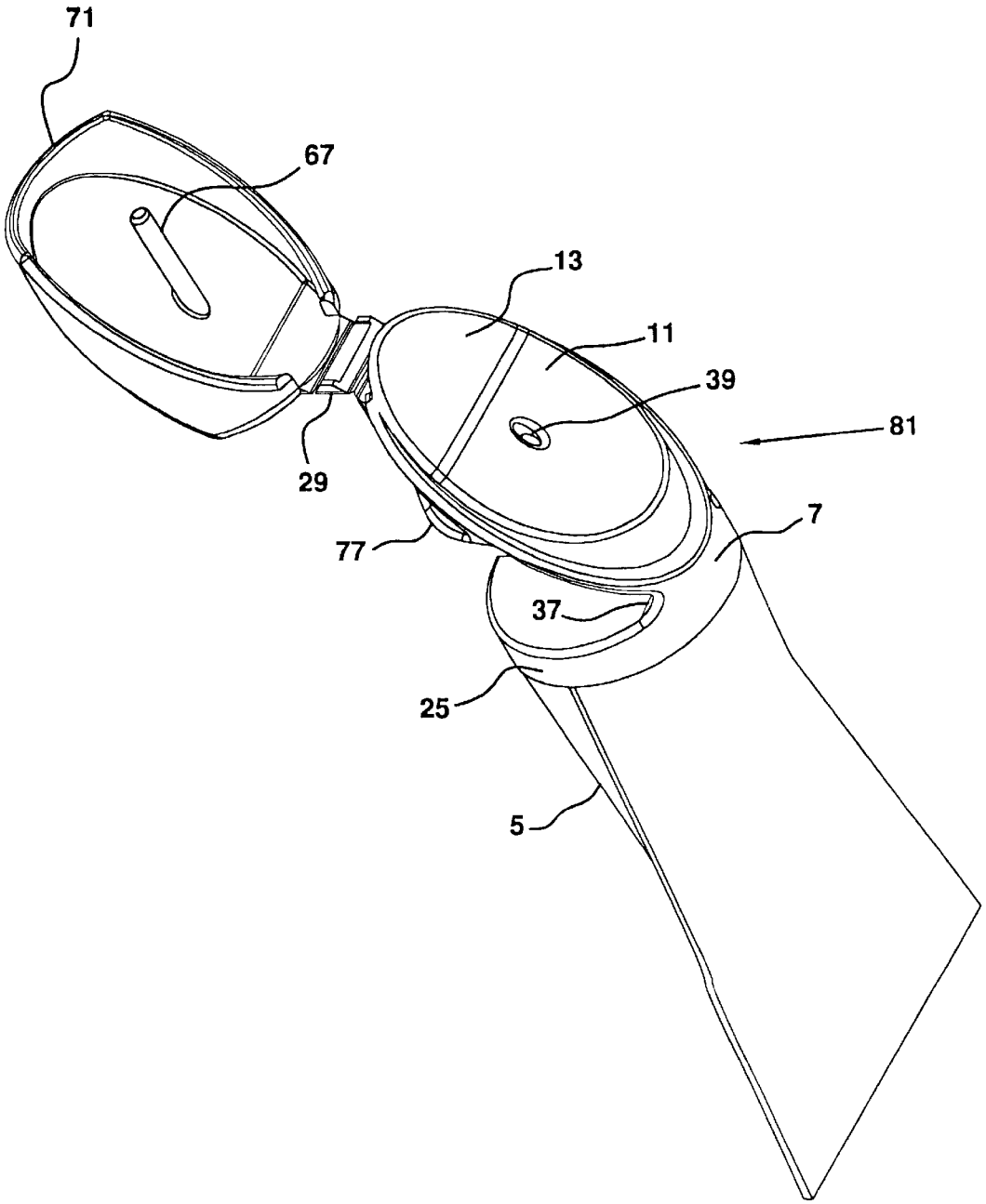
FIG. 24 is another perspective open view of the applicator top shown in FIG. 23.
Figure 25:
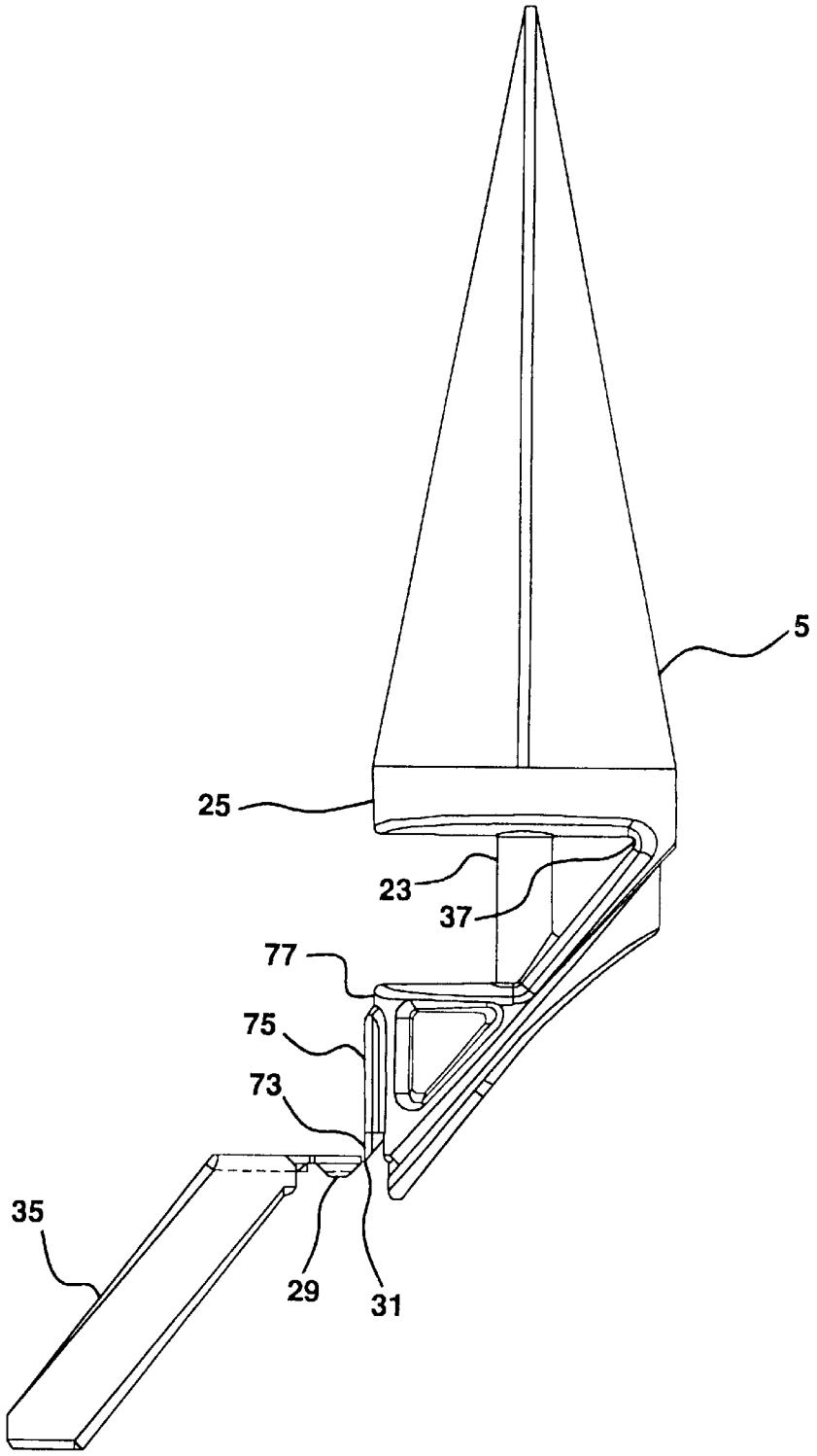
FIG. 25 is a side view of the applicator top and tube shown in FIG. 24 with the cap in open molded position.
Figure 26:
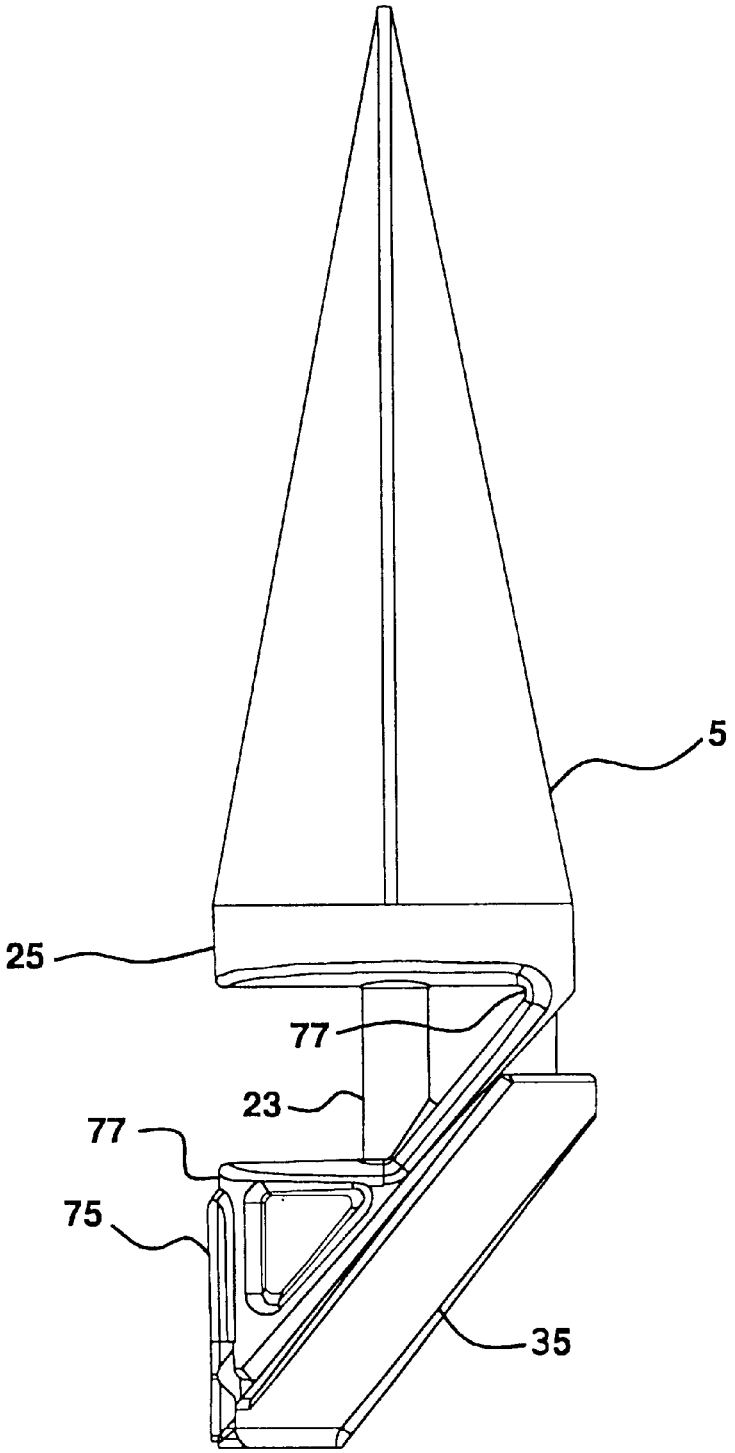
FIG. 26 is a side view of the applicator top shown in FIG. 25 with the cap closed.
Figure 27:
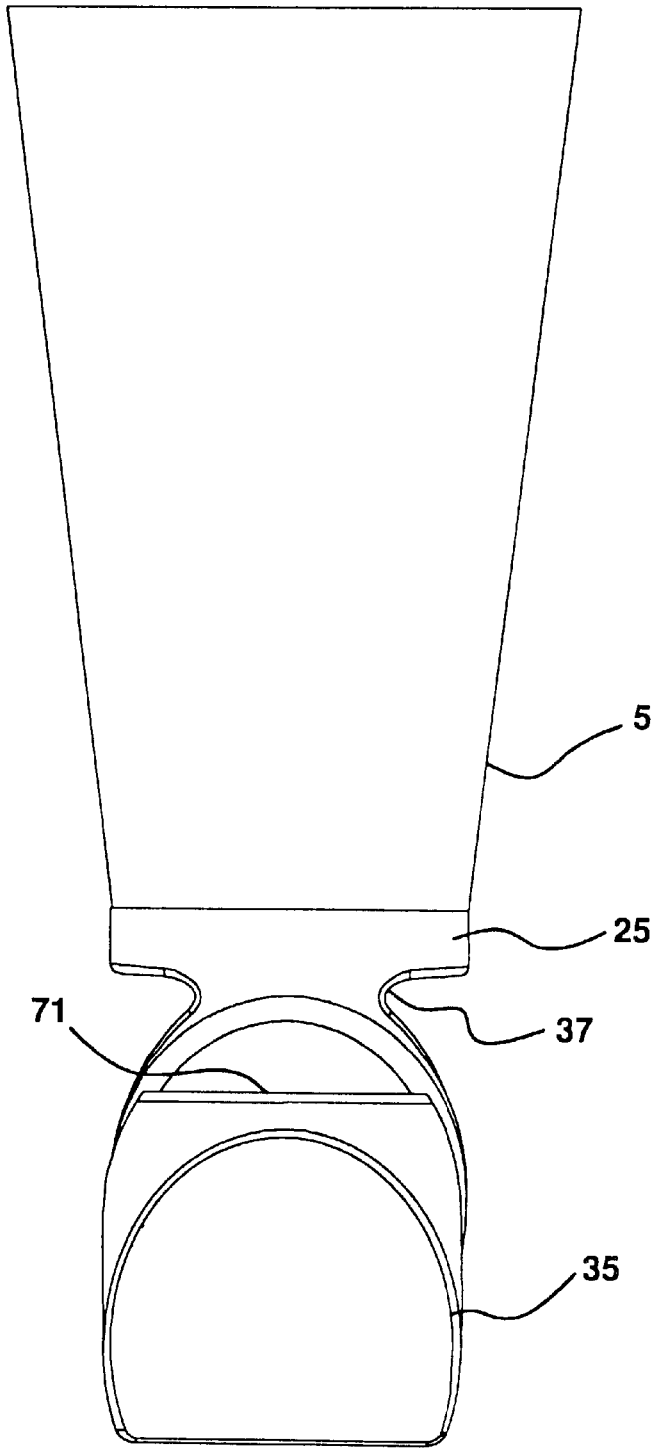
FIG. 27 is a side elevation from the cap side.
Figure 28:
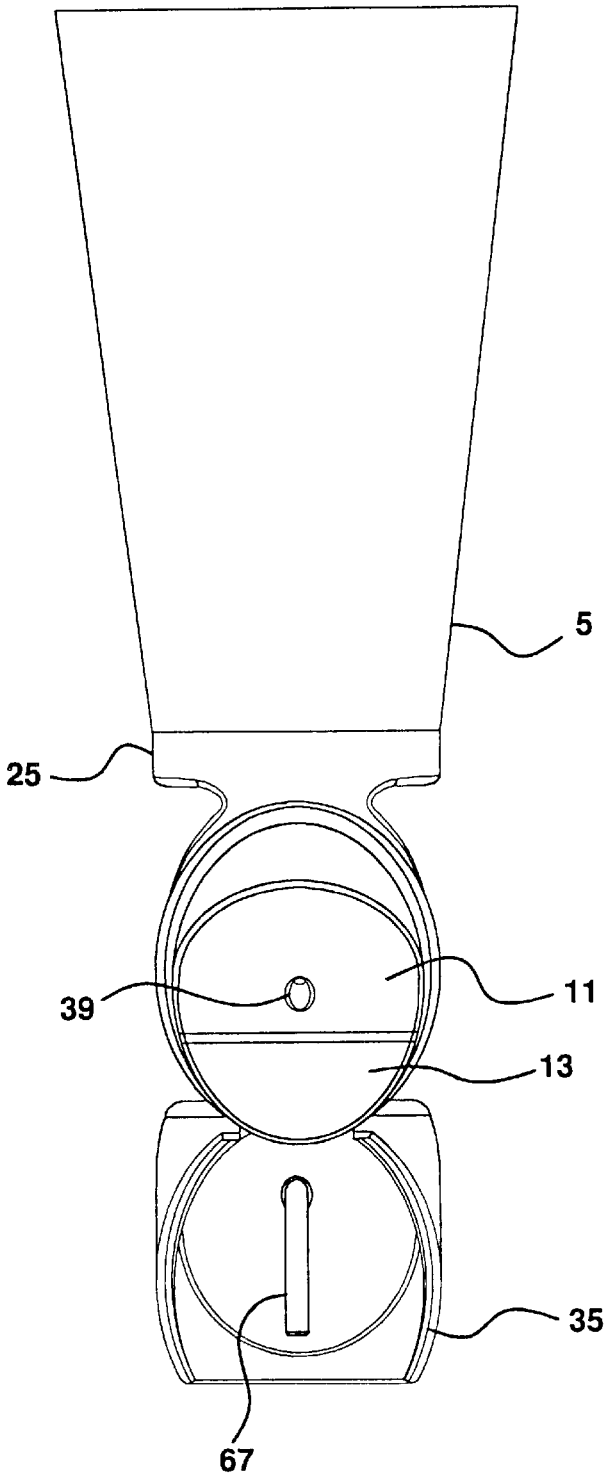
FIG. 28 is a side elevation similar to FIG. 27 with the cap open.

Another view of the dispenser head is shown in FIG. 24. A side view is shown for clarity in FIG. 25 with the cap 35 open, and in FIG. 26 with the cap 35 closed. A front view of the container showing the flat end 71 of the cap 35 is shown in FIG. 27. A front view with the cap open is shown in FIG. 28.

Figure 29:
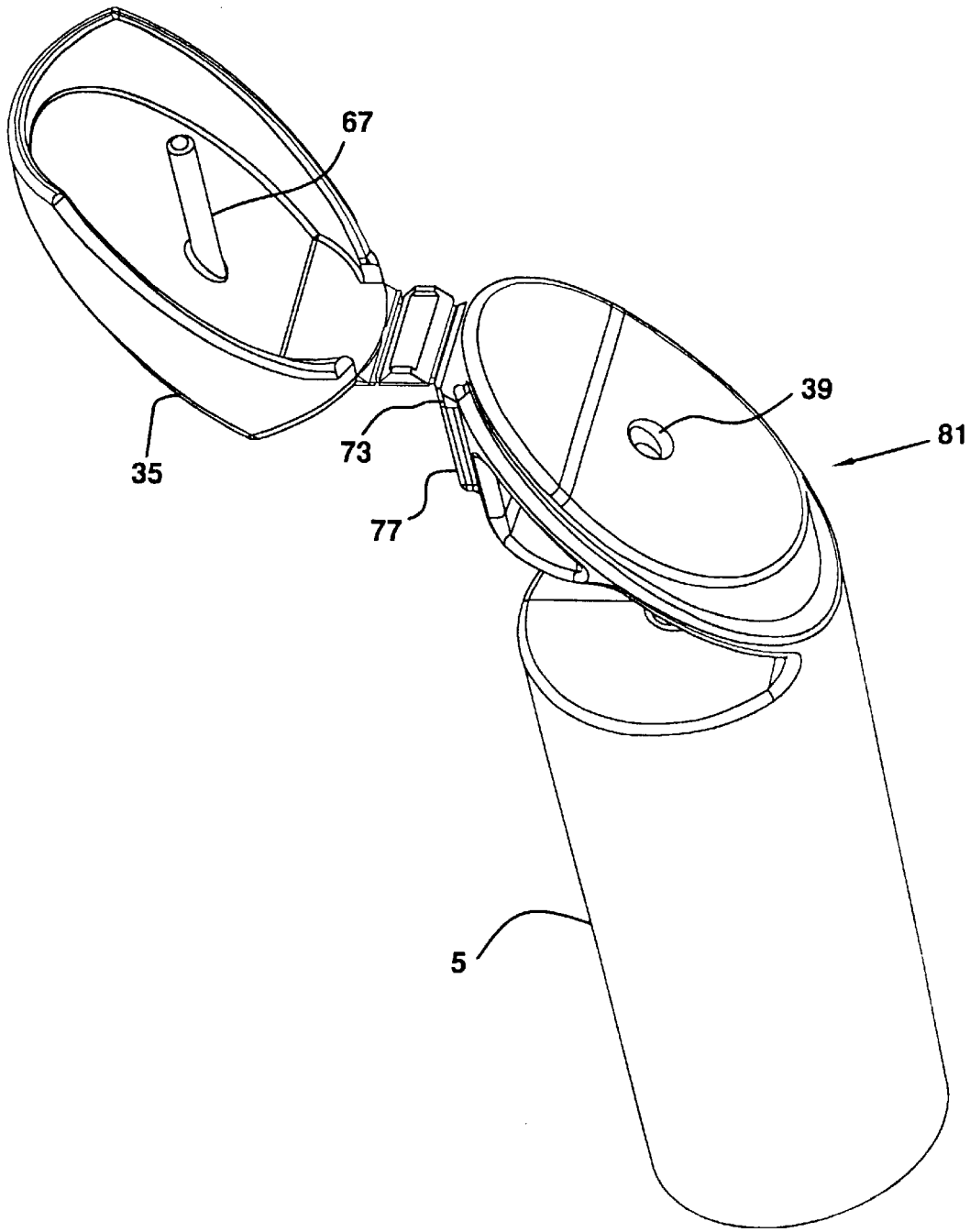
FIG. 29 shows the body molded condition prior to filling the contents and sealing.

FIG. 29 shows the dispenser head 81 and container body 5 in molded condition after the cap has been connected with the cap blade 73 inserted in the receiver 77, and before the molded body 5 is filled with contents and sealed.

Figure 30:
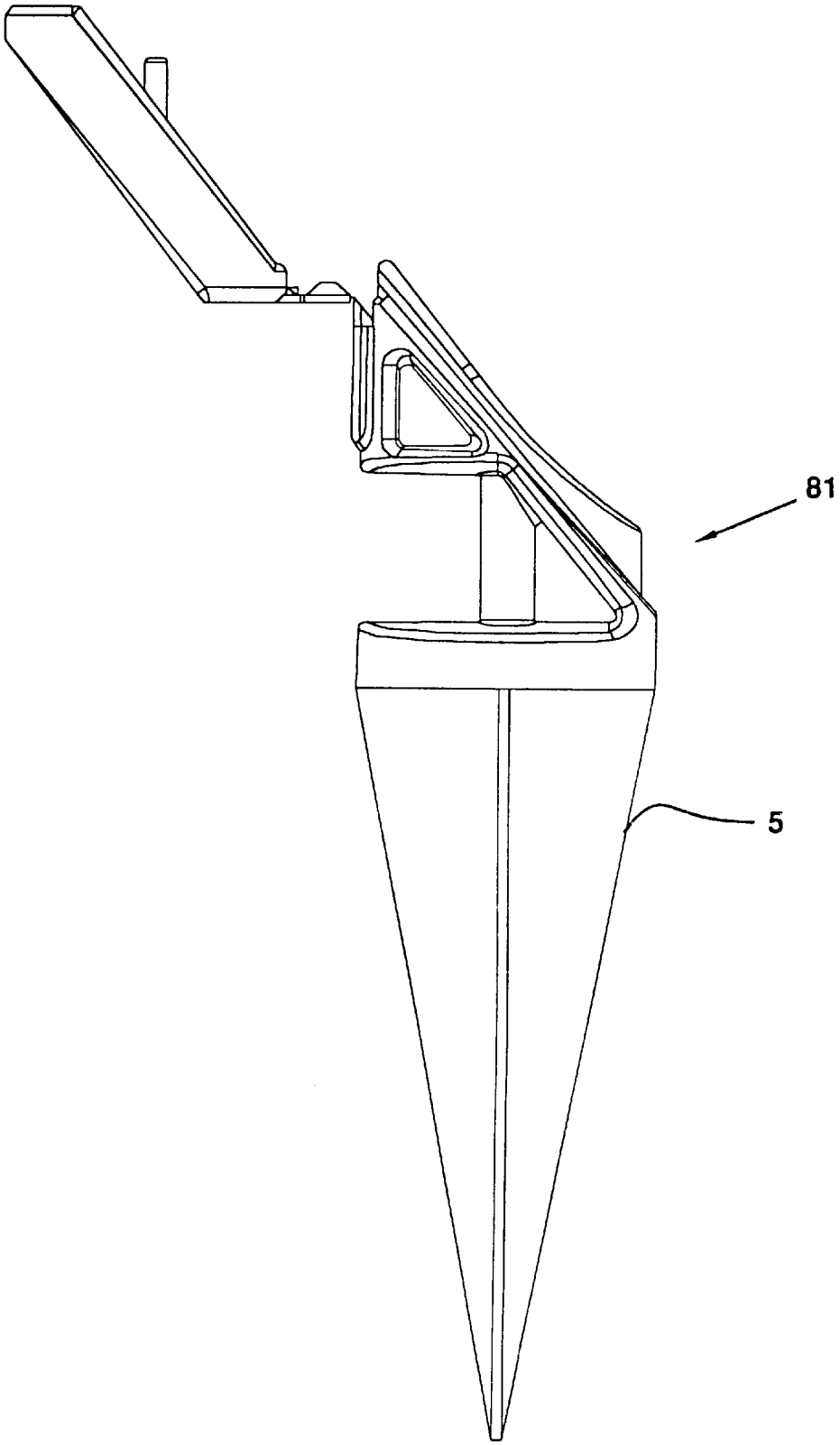
FIG. 30 shows the body molded after the contents are filled and the tube is sealed.

FIG. 30 shows the applicator shown in FIG. 29 after the container body 5 is filled and sealed.

Figure 31:
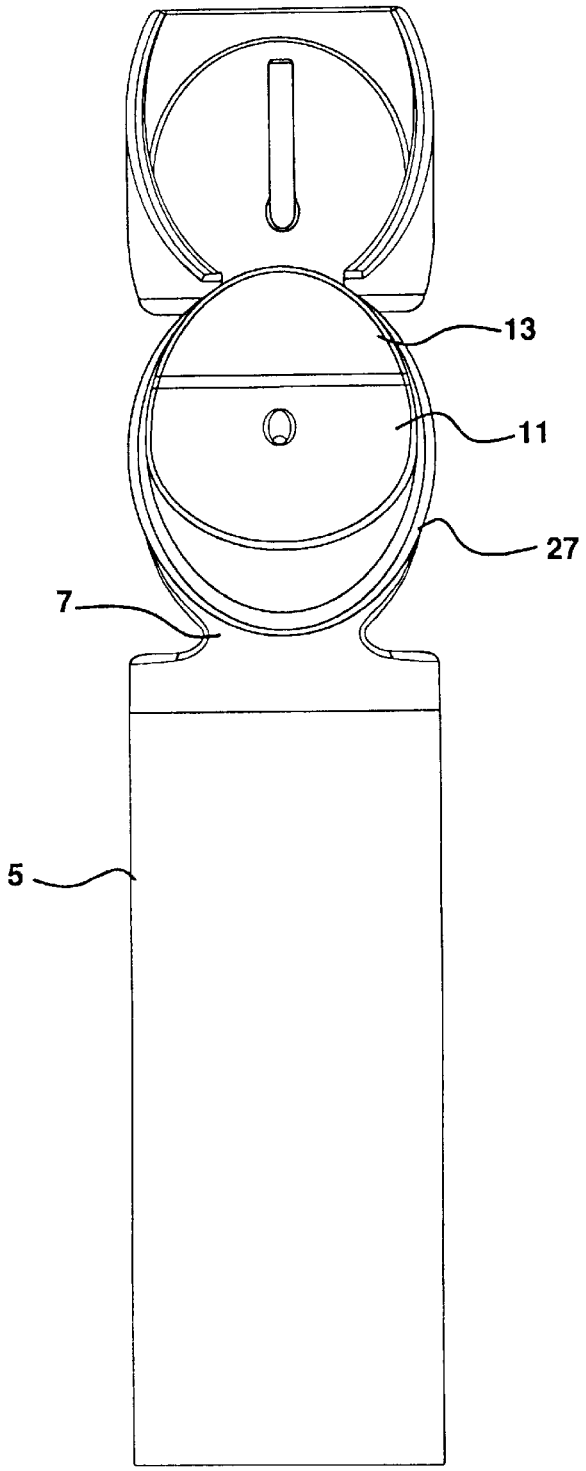
FIG. 31 is a front elevation showing the printed tube, applicator and cap ready for decorating.

FIG. 31 shows the unfilled container on which the cap is assembled. The body 5, wall 7 and wall 27, and the parts underlying the applicator surfaces 11 and 13 are made of structural material. The applicator surfaces 11 and 13 are coated with compliant material which is soft to the touch.

Figure 32:
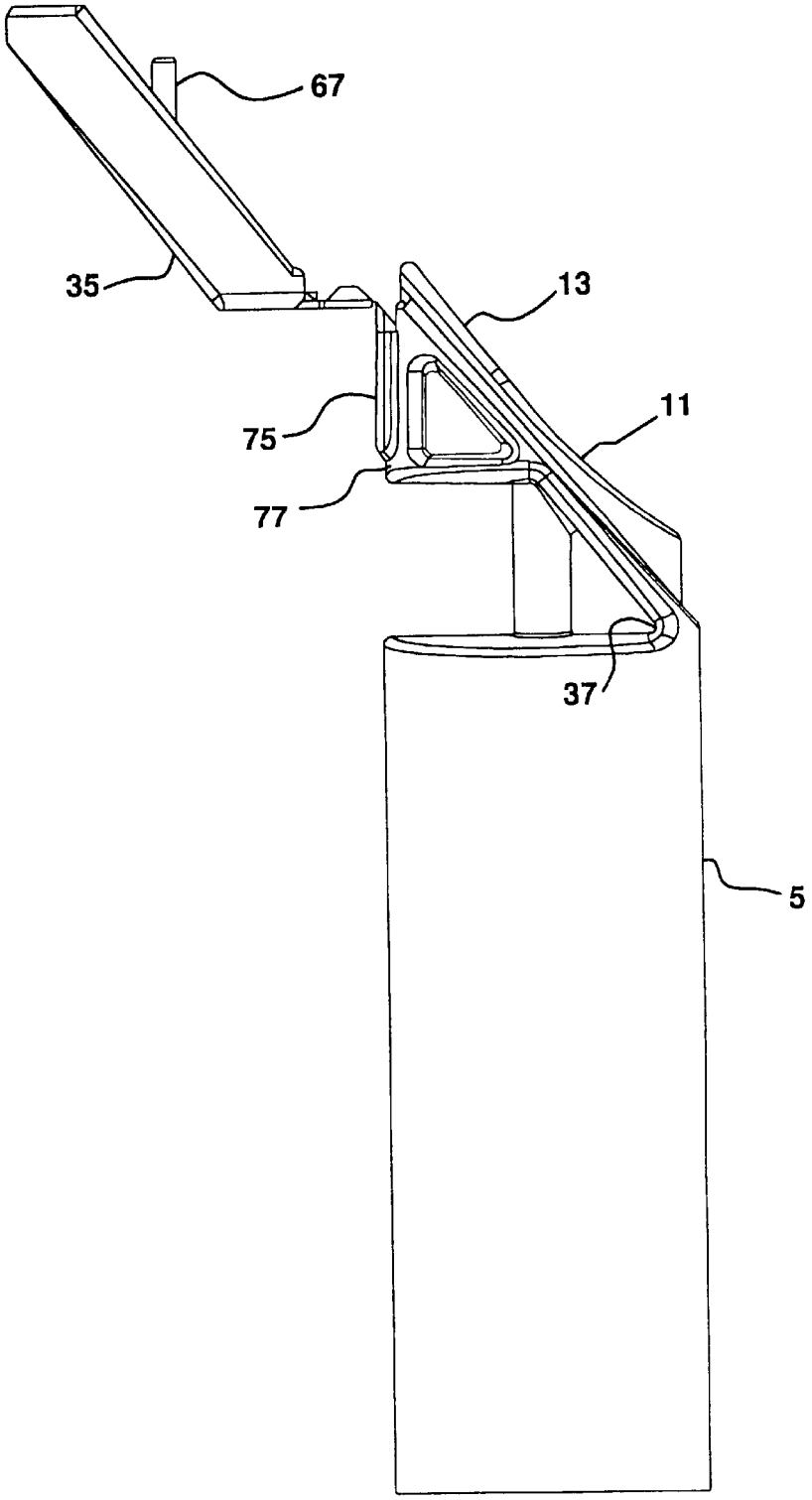
FIG. 32 is a side view of the body applicator and cap shown in FIG. 31.

FIG. 32 is a side view of the structure shown in FIG. 31 showing the layers of compliant material 11 and 13 which form the applicator surface.

Figure 33:
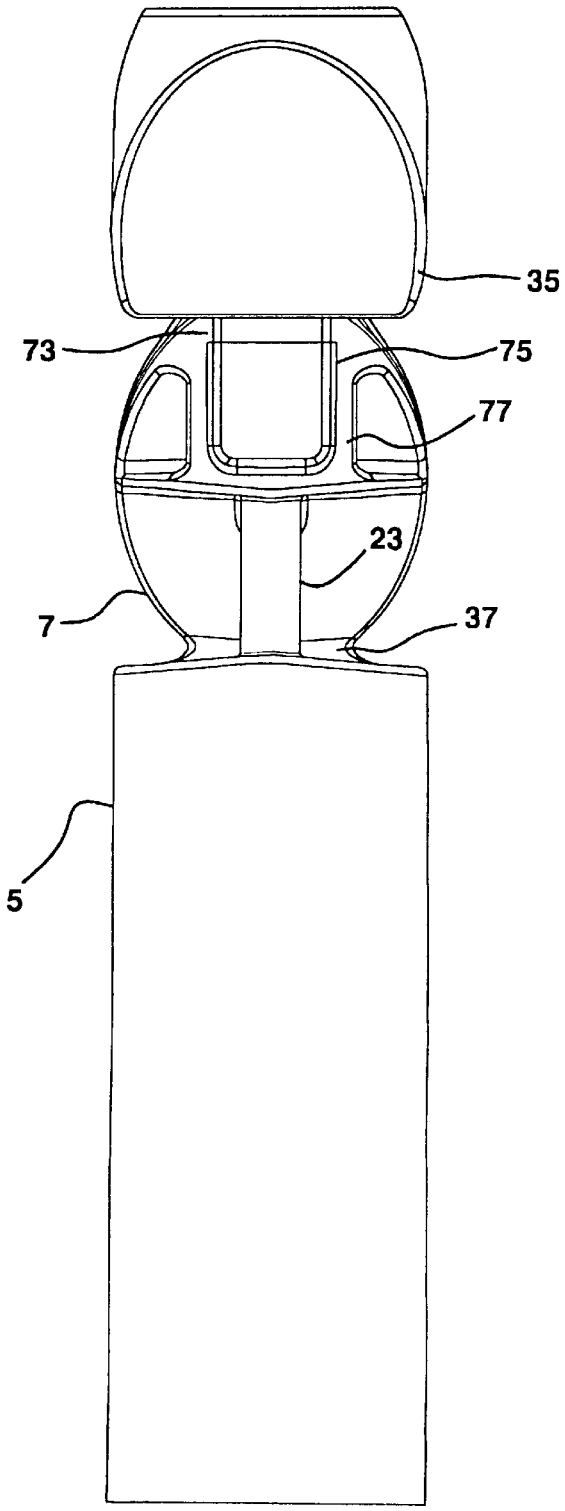
FIG. 33 is a rear elevation of the body applicator and cap shown in FIGS. 31 and 32.

FIG. 33 is a rear view showing how the separately molded cap 35 is connected with the connector blade 73 mounted in the recess 75 on the rear downward extension 77 of the applicator head. The applicator head and body 5 are molded in one piece with side actions forming the rear of the wall 7. The flex area 37, the flow channel 23 which may be solid or compliant, and the openings in the extension 77 are molded with side actions.

Figure 34:
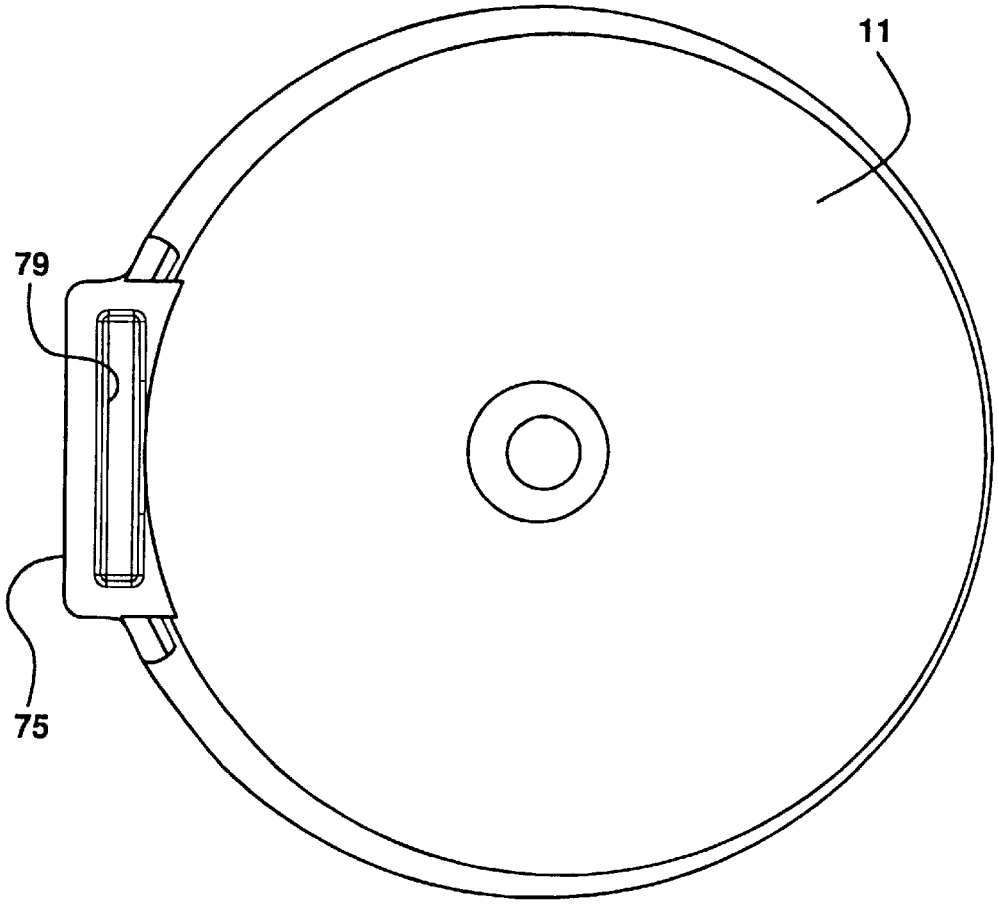
FIG. 34 is a top view of the applicator shown in FIGS. 1–33 showing the receptacle for the cap connector blade.

FIG. 34 is a top view showing the receiver 75 and the recess 79 for receiving the connector blade of the cap.

Figure 35:
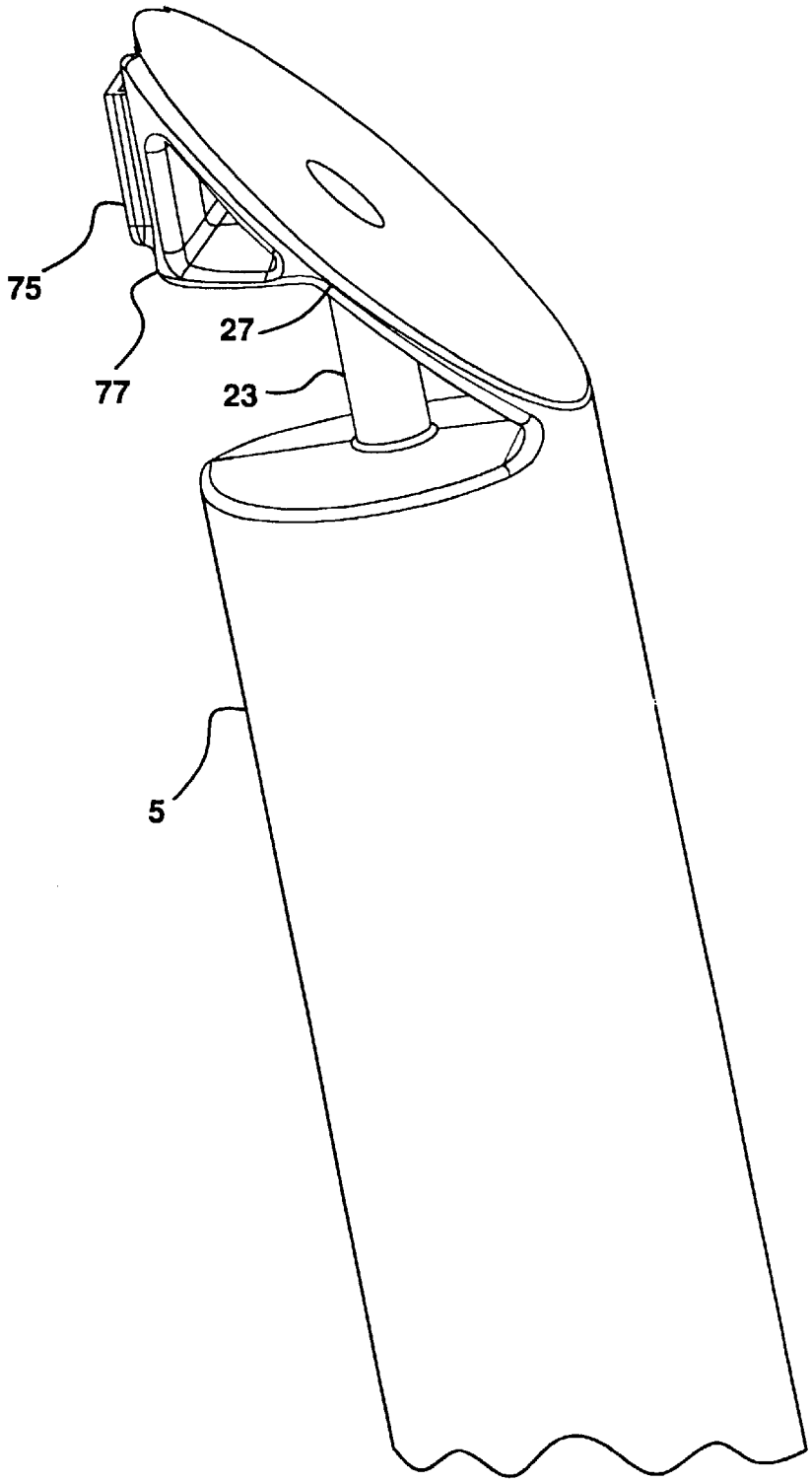
FIG. 35 is a perspective view showing the body and applicator as molded with a first shot of material.

FIG. 35 shows the apparatus formed in the mold with the first shot of structural material in which the container 5, the flow channel 23, the upper wall 27, the rear extension 77 and the receiver 75 are formed with a first shot of material.

Figure 36:
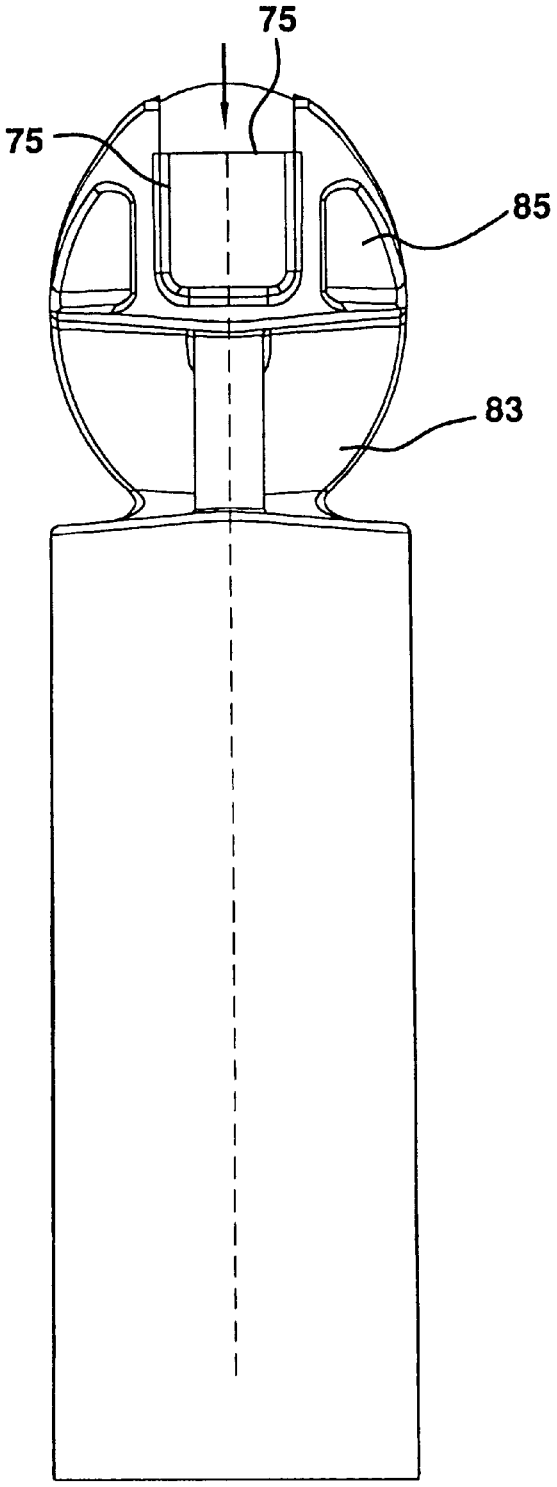
FIG. 36 is a rear view of the body and applicator shown in the first step of molding.

FIG. 36 shows the structure formed in the mold in the first shot with the cored out areas 83 and 85 at the rear of the applicator head, and the cored out recess 79 in the receiver 75.

Figure 37:
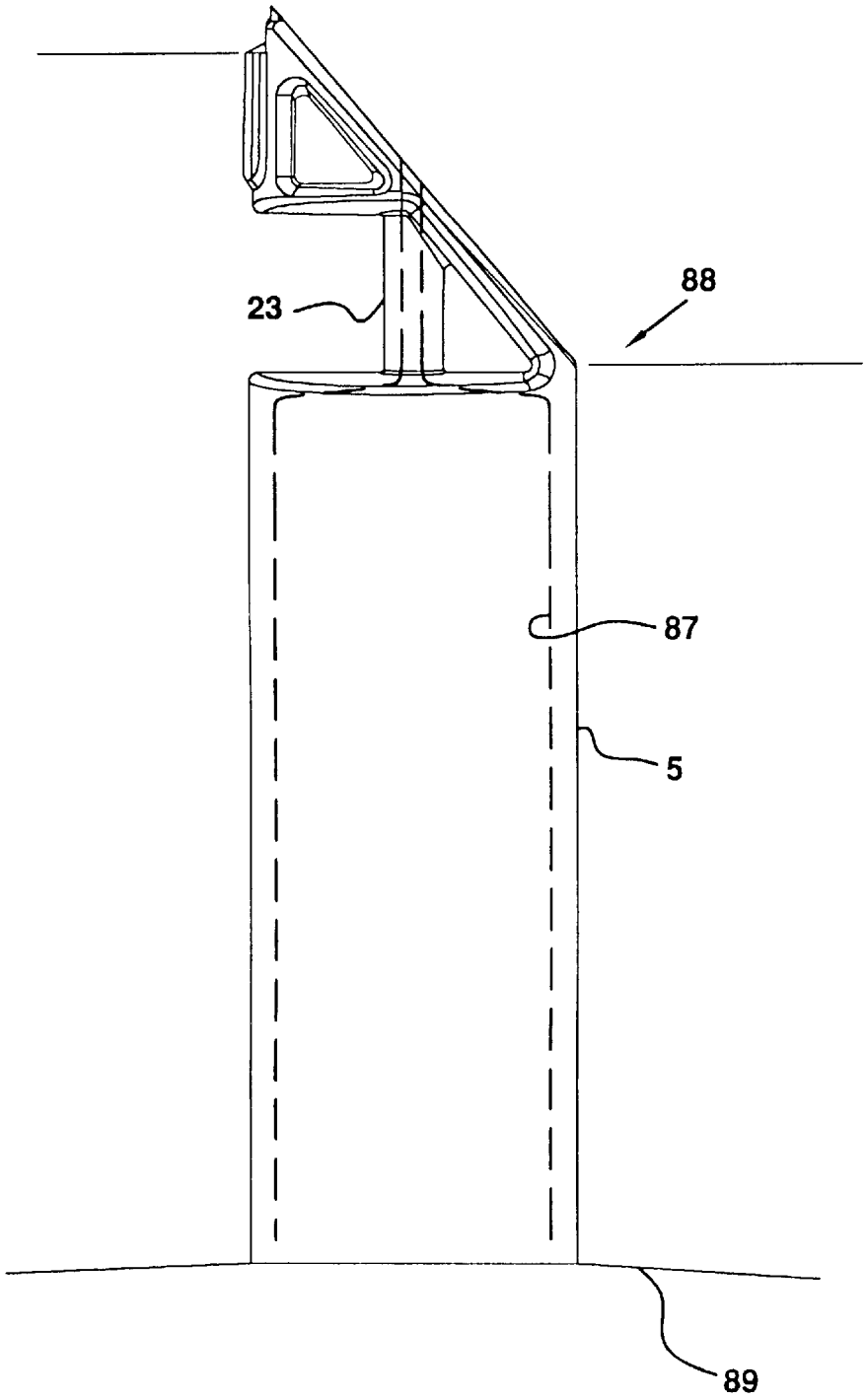
FIG. 37 a side view showing the mold core and the front and back halves of the mold.

FIG. 37 is a side view of the apparatus in the mold with a core 87 positioned within the container 5 and the flow channel 23, with the upper part 88 representing the front half of the mold and the lower part 89 representing the back half of the mold.

Figure 38:
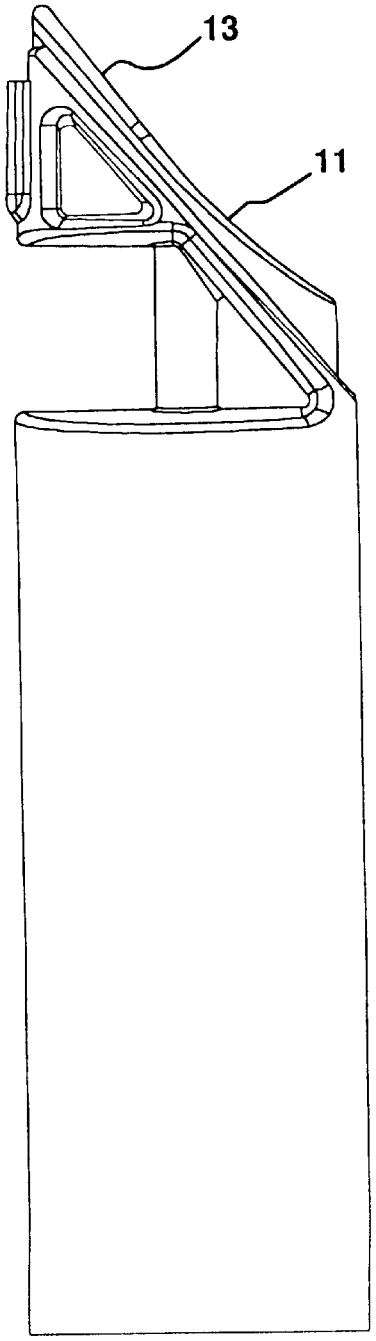
FIG. 38 is a side elevation showing the molded body and applicator after a second shot of compliant material on the applicator.

FIG. 38 shows how a second shot of compliant material is added to form the applicator surfaces 11 and 13.

Figure 39:
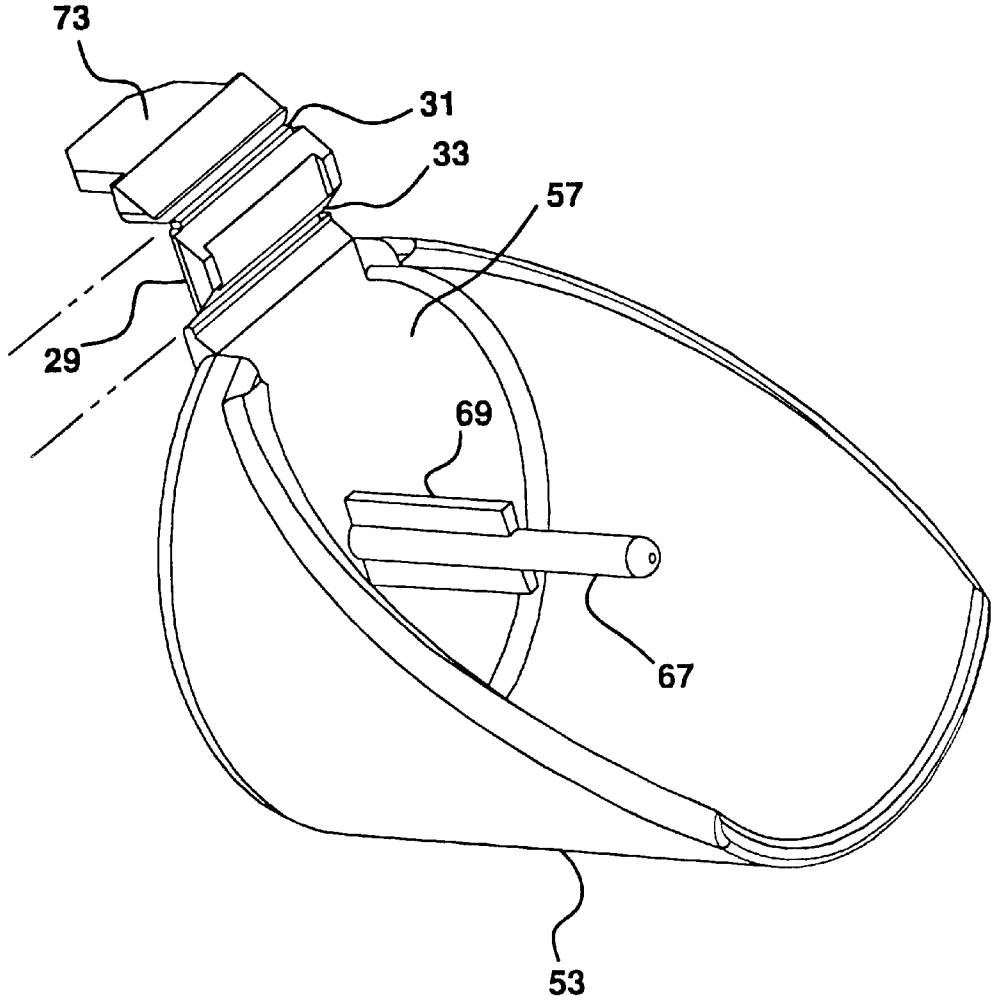
FIG. 39 is a perspective view of a molded cap used in the construction shown in FIGS. 22–38 showing the connector blade.

FIG. 39 is a detail of the molding of the cap 53 with the plug post 67 and reinforcements 69 connected to the top 57 of the cap, and the double hinge piece 29 molded with living hinges 33 and 31 which connect the cap to the connector blade 73.

Figure 40:
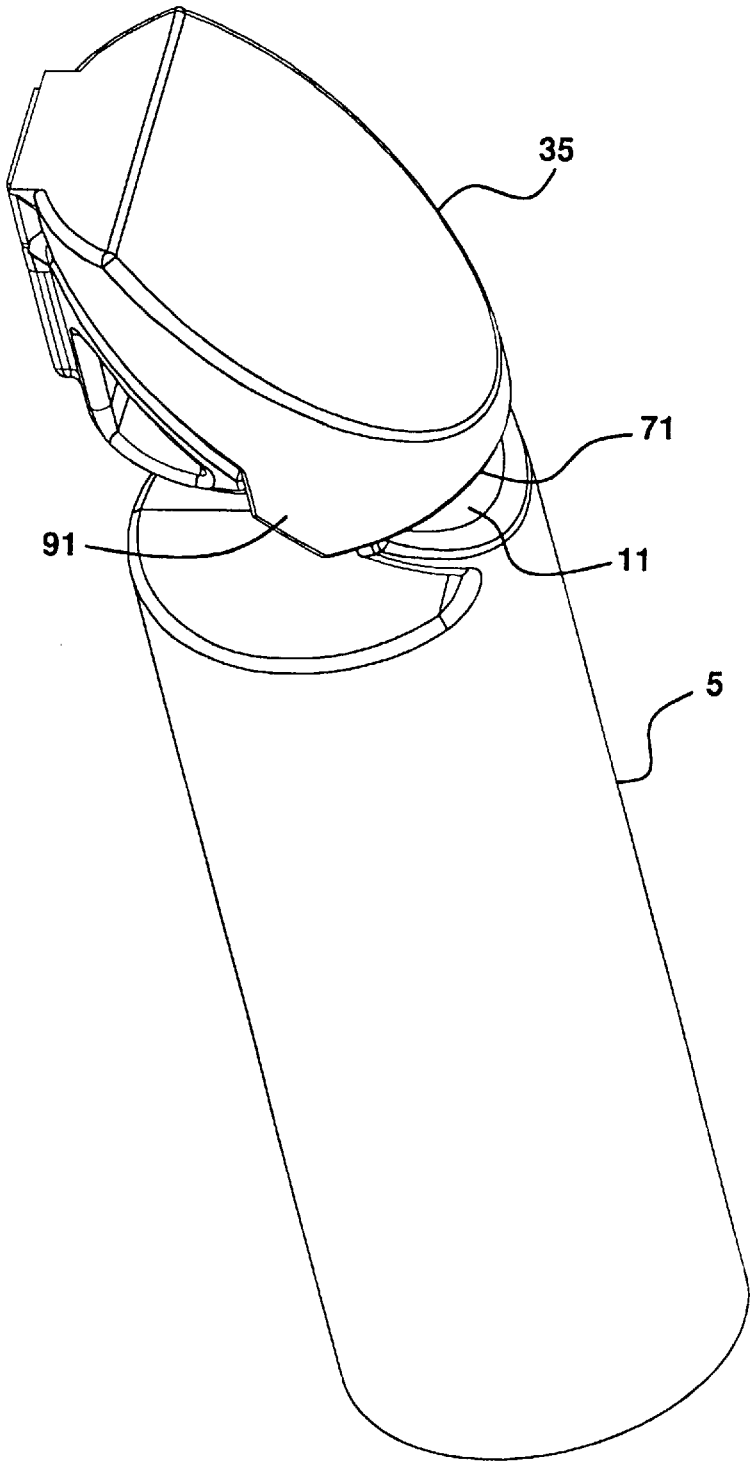
FIG. 40 is a perspective view of an unfilled container with an applicator top and a snap closed cap.

FIG. 40 shows the cap 35 with modified snap side extensions 91 to hold the cap closed. The relief 71 on the end of the cap allows the compliant material 11 to be seen, and also allows the user to open the cap.

Figure 41:
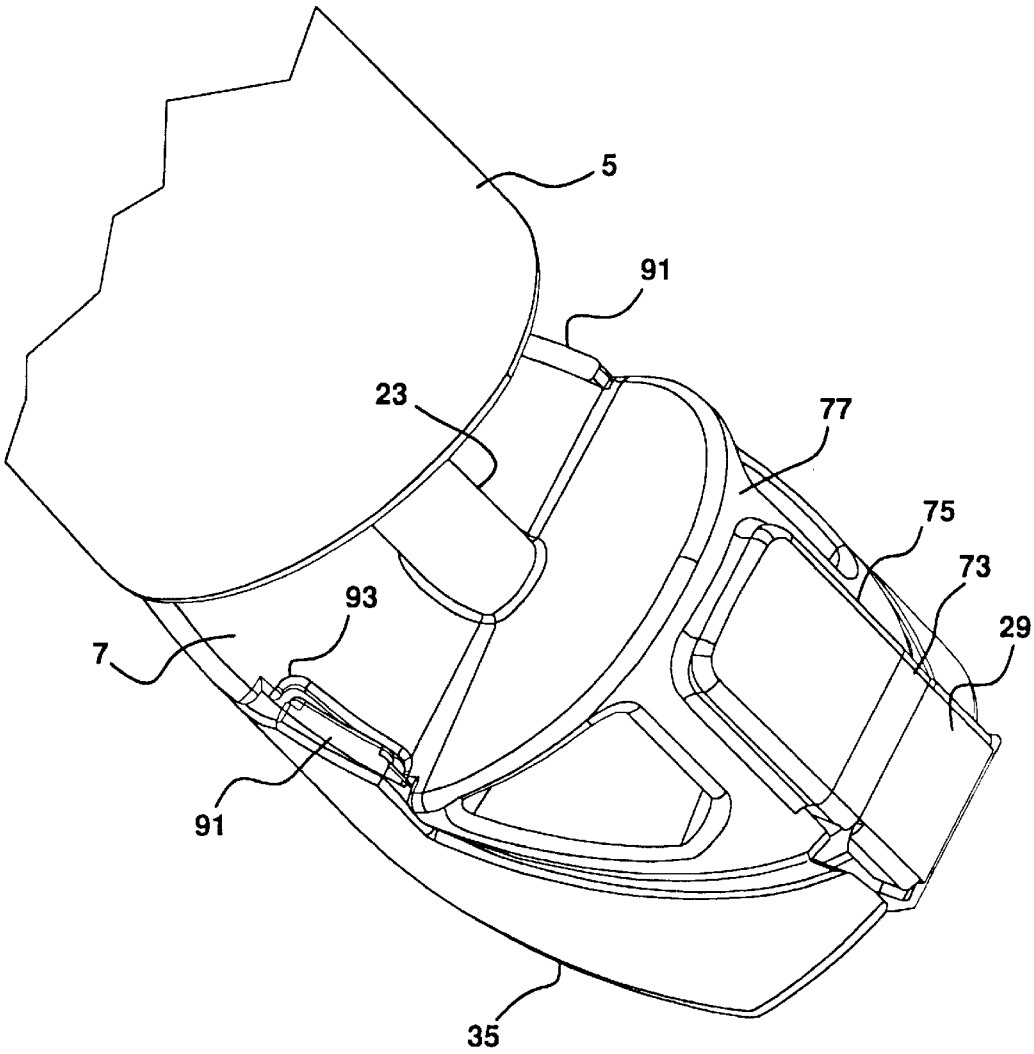
FIG. 41 is a perspective inverted view showing side snaps on the cap.

FIG. 41 is an inverted detail of the cap 35 showing the snap extensions 91 held in the complementary snap receivers 93 formed on the back of wall 7.

Figure 42:
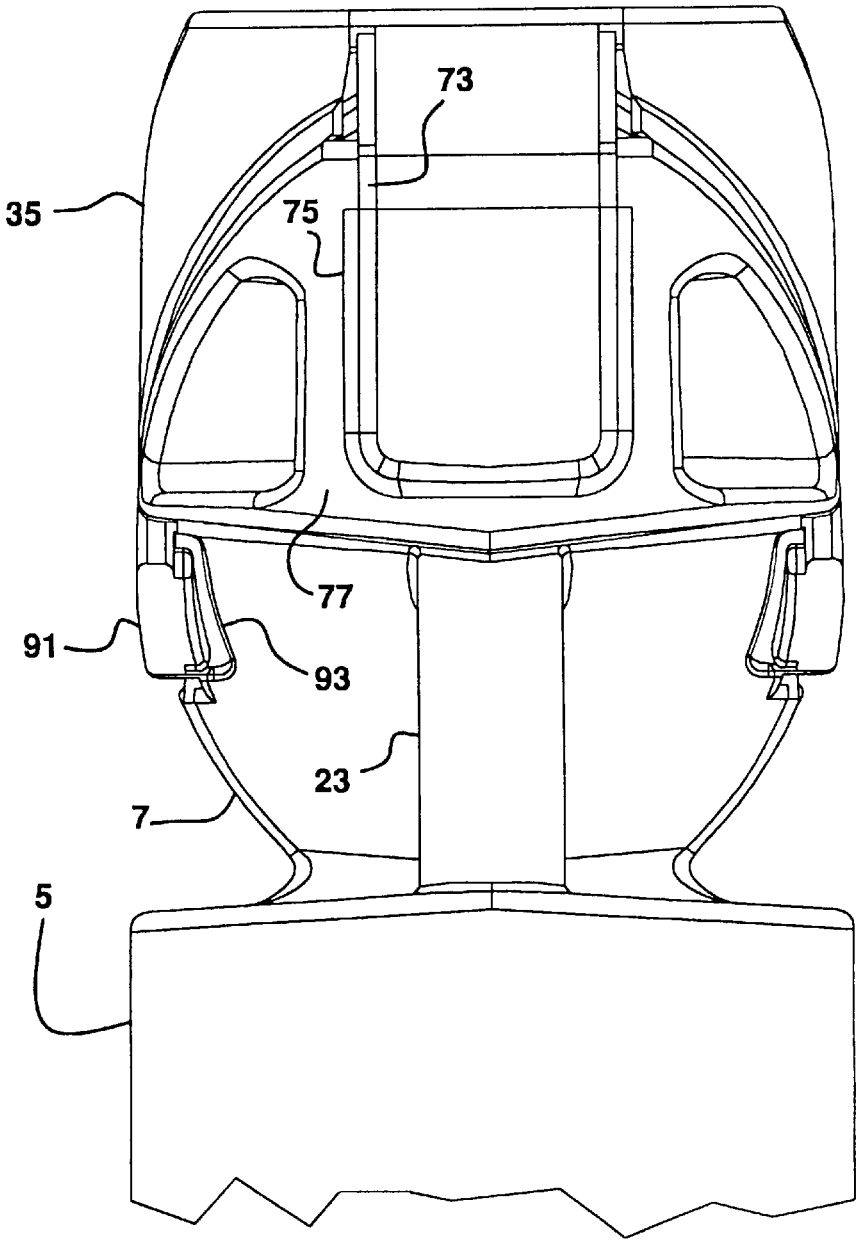
FIG. 42 is a detail showing the side snaps.

FIG. 42 is a detail of the cap snap 91 and the receiver 93 on the dispenser head.

Figure 43:
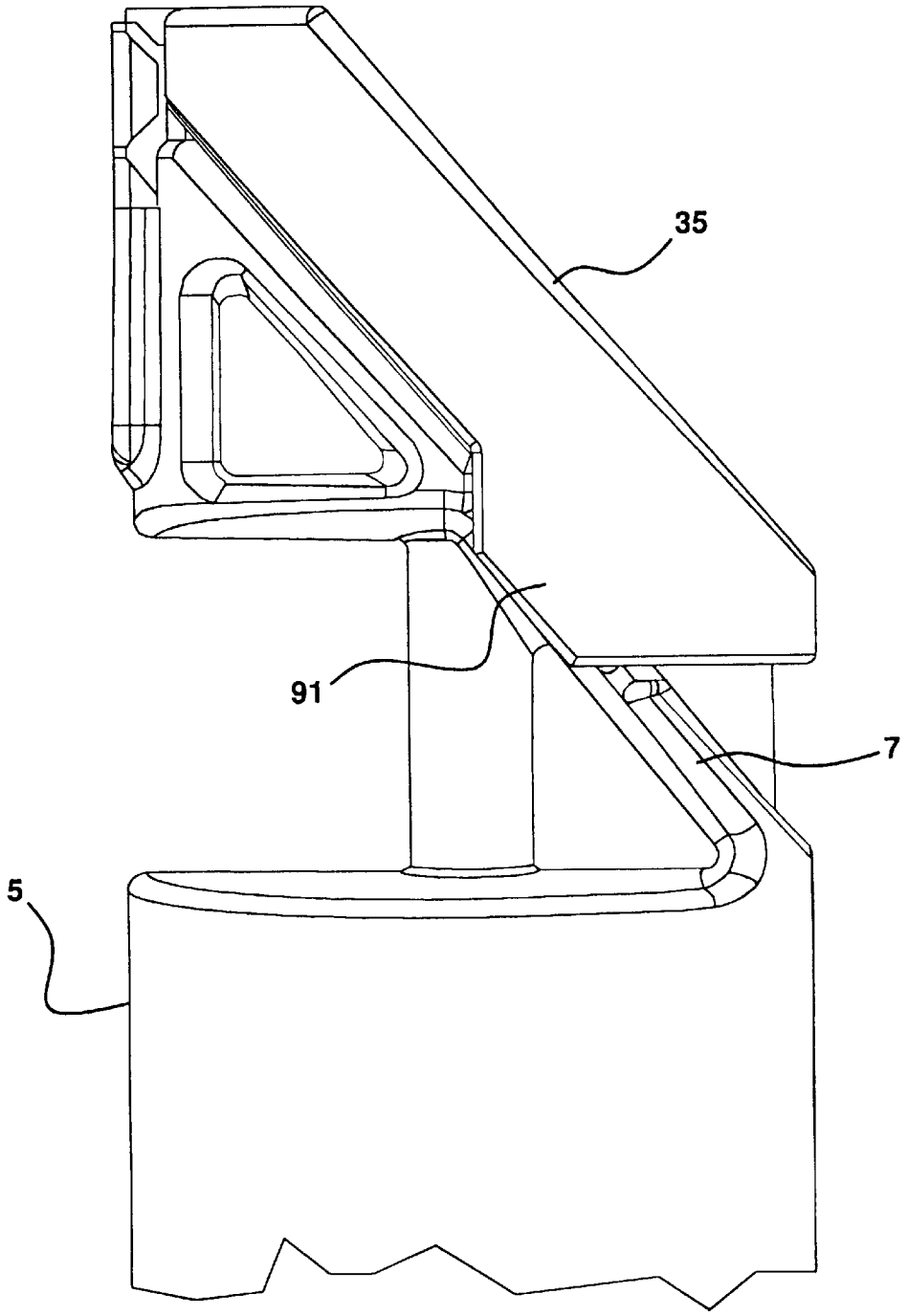
FIG. 43 shows a cap with an extension which snaps past the cap neck to hold the cap closed.

As shown in FIG. 43, the cap extension 91 locks and snaps past the dispenser head wall 7 to hold the cap 35 closed.

Figure 44:
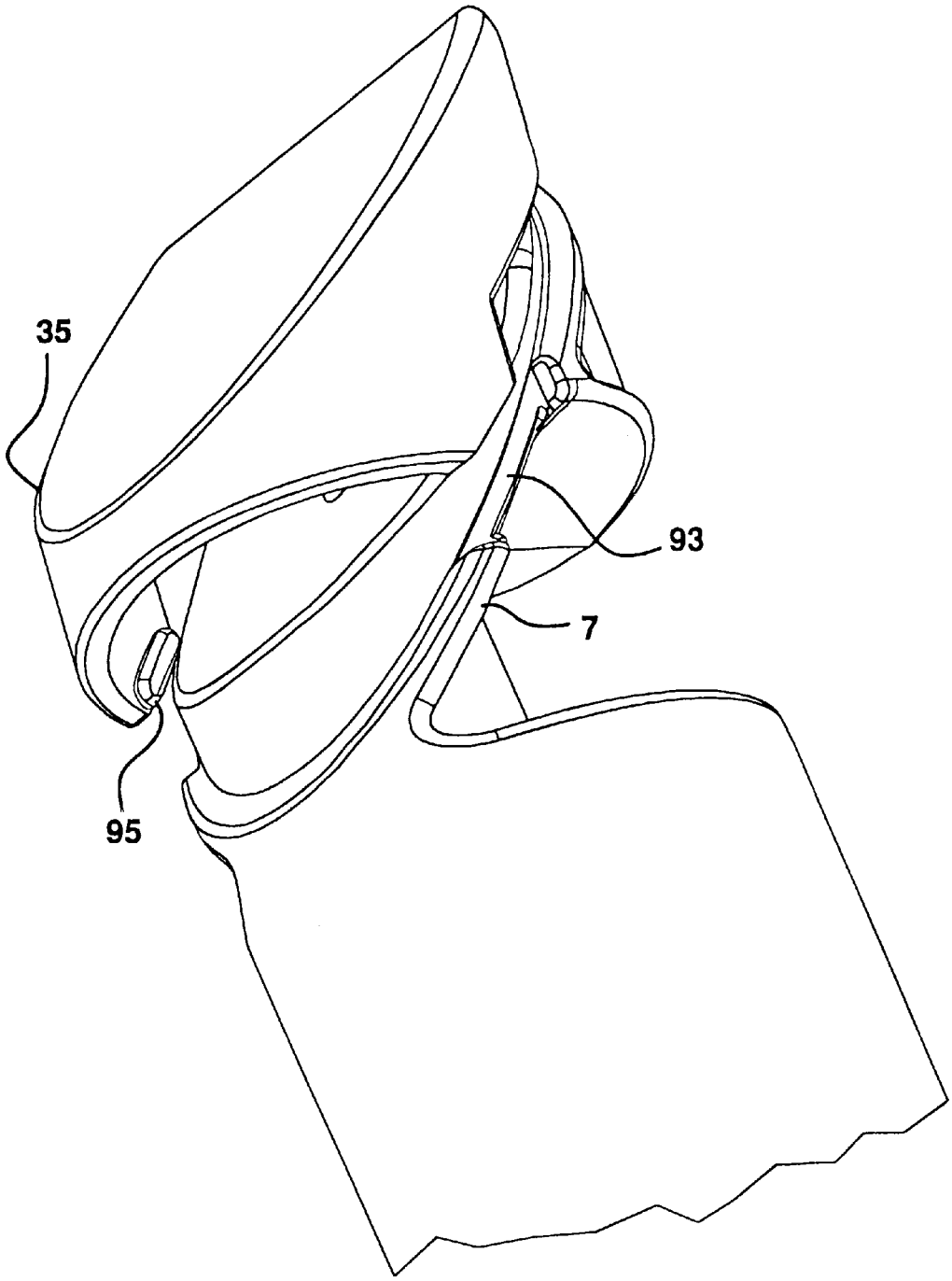
FIG. 44 is a perspective view showing a partially closed or open cap showing how the side extensions flex outwardly.

As shown in FIG. 44, one of the inward cap extensions 95, which extends inward from the cap snap 91, fits in the recess 93 formed in the wall 7 of the dispenser head.

Figure 45:
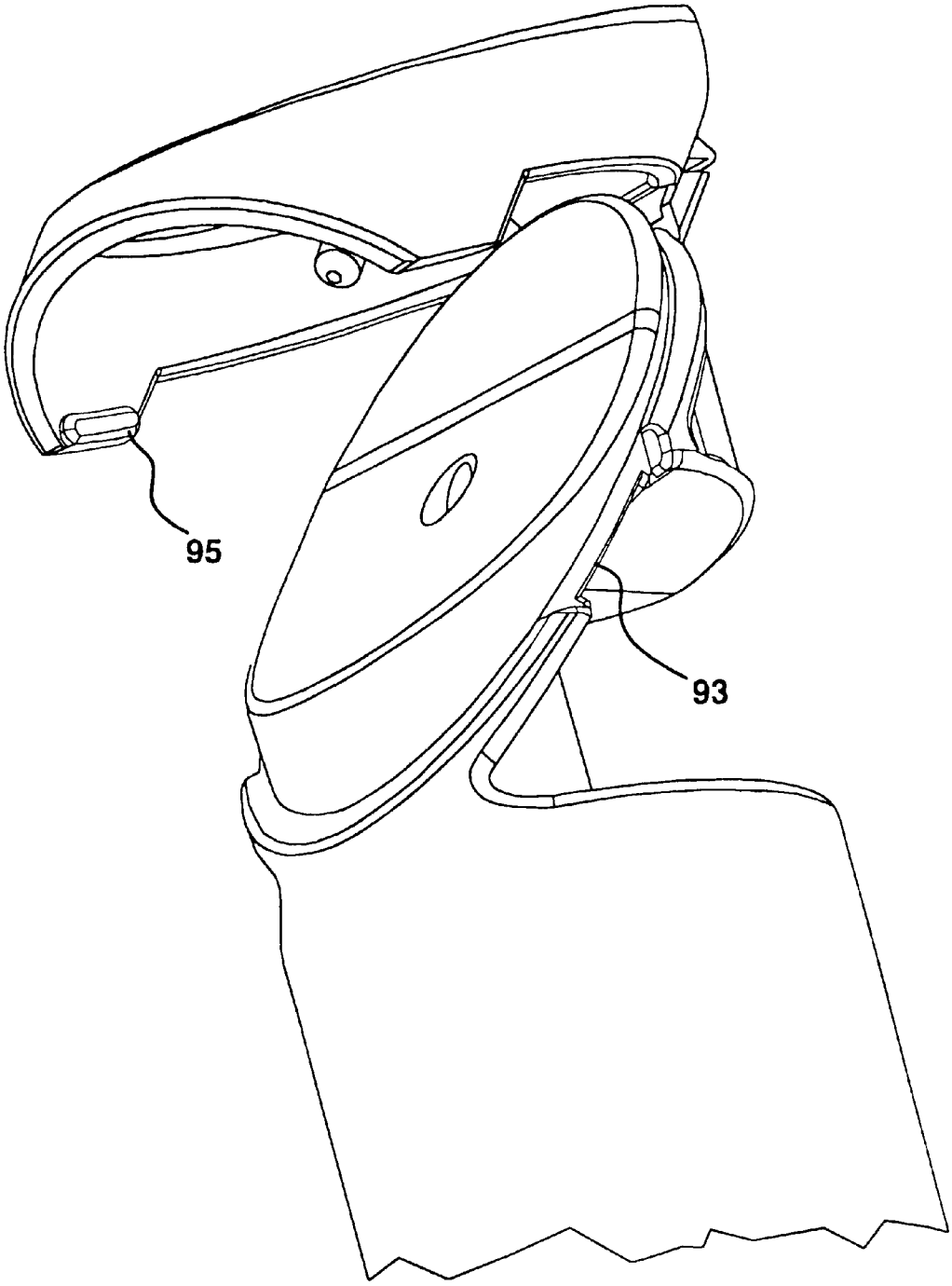
FIG. 45 is a detail showing the closing of the cap.

FIG. 45 shows rotating the cap 35 downward to snap the inward extensions 95 in the recesses 93.

Figure 46:
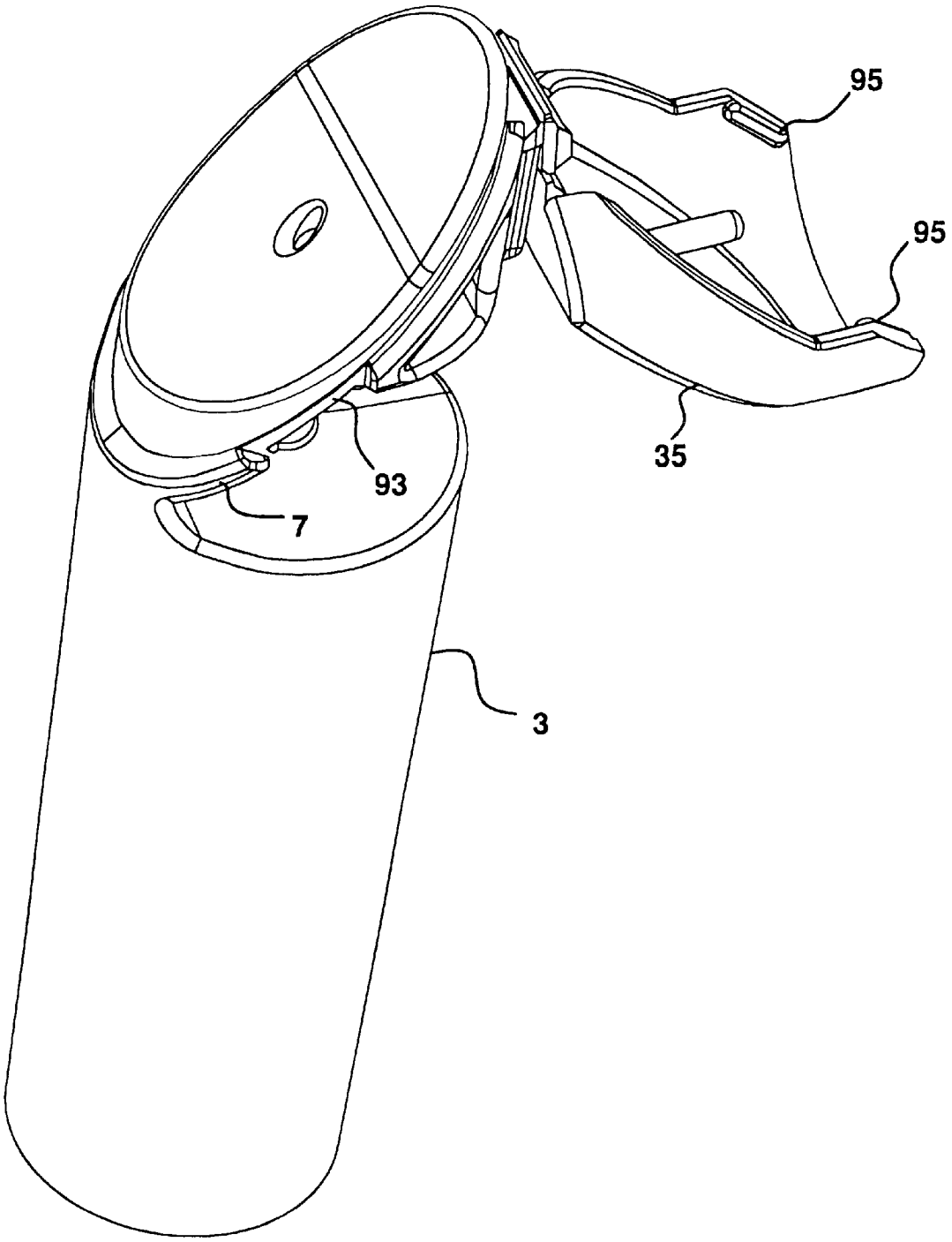
FIG. 46 is a perspective view showing the hinge cap, applicator and container body.

FIG. 46 shows the inward extending snaps 95 in the cap 35, which fit within the recesses 93 on sides of the wall 7.

FIGS. 47–50 show details of a preferred compliant valve, such as shown in FIGS. 6, 7, 9 and 11–13, that can be used with any dispenser head.

Figure 47:
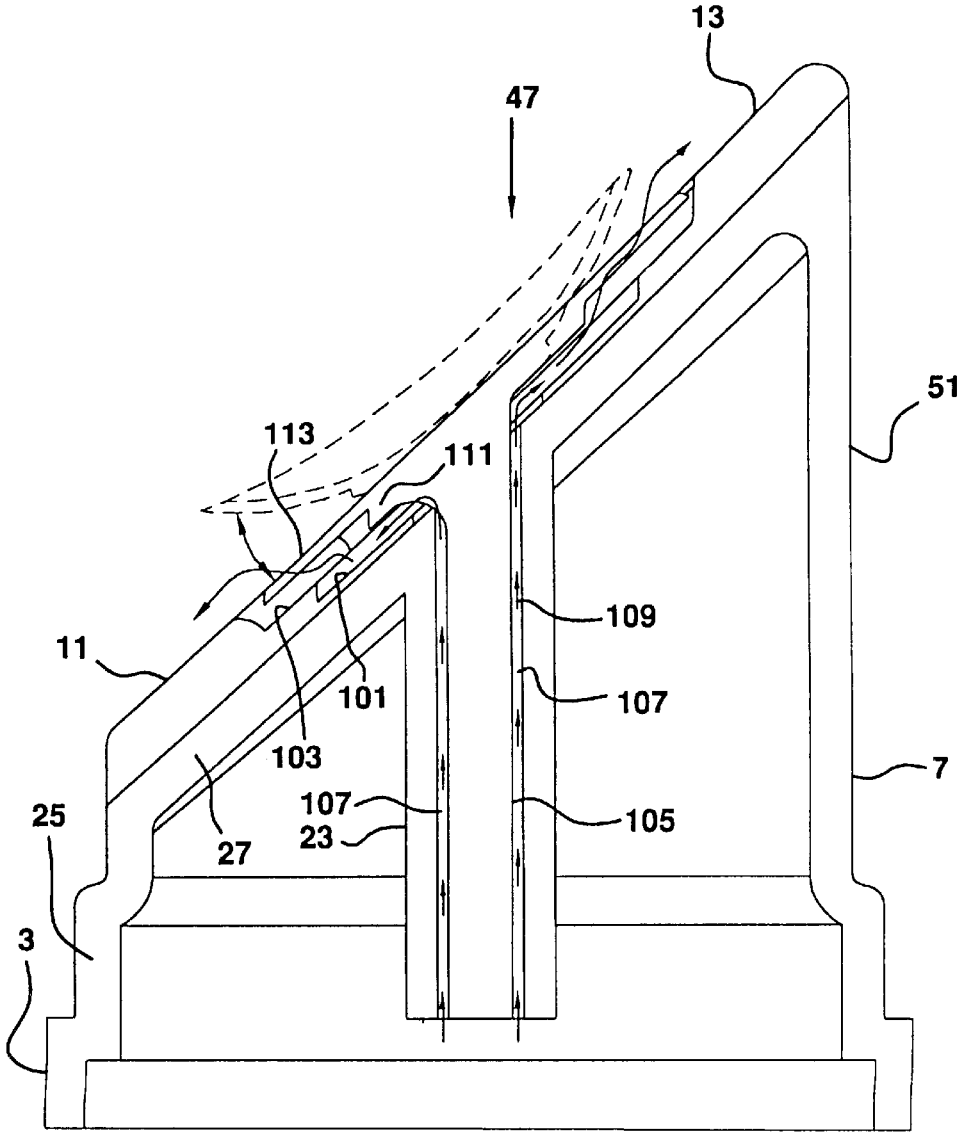
FIG. 47 is a detail showing the flow of material outward from the container past a compliant valve.

As shown in FIG. 47, the applicator head 51 is made of structural material. That includes the color 3, the wall 7, the flow tube 23, the base 25 and the upper part 27. Compliant material 11 and 3 is added in an annular ring.

Central stepped recesses 101 and 103 are formed in the applicators 11 and 13.

Valve 47 is made out of compliant material. A stem 105 of the valve 107 is pressed within the flow tube 23. Longitudinal ridges on the stem provide flow channels 107 around the stem on the inside of the flow tube 23. Material 109 flows through the channels 107. The valve 47 is made of a compliant disc. A central 111 is thick and fits within the recess 101. A thinner outer portion 113 rests against the ledge 103.

In FIG. 47 the valve 47 is shown not fully pushed into the recesses for clarity on the distinctions between the parts. The valve 47 is also shown in dash lines to show the flexibility of the upper disc.

Figure 48:
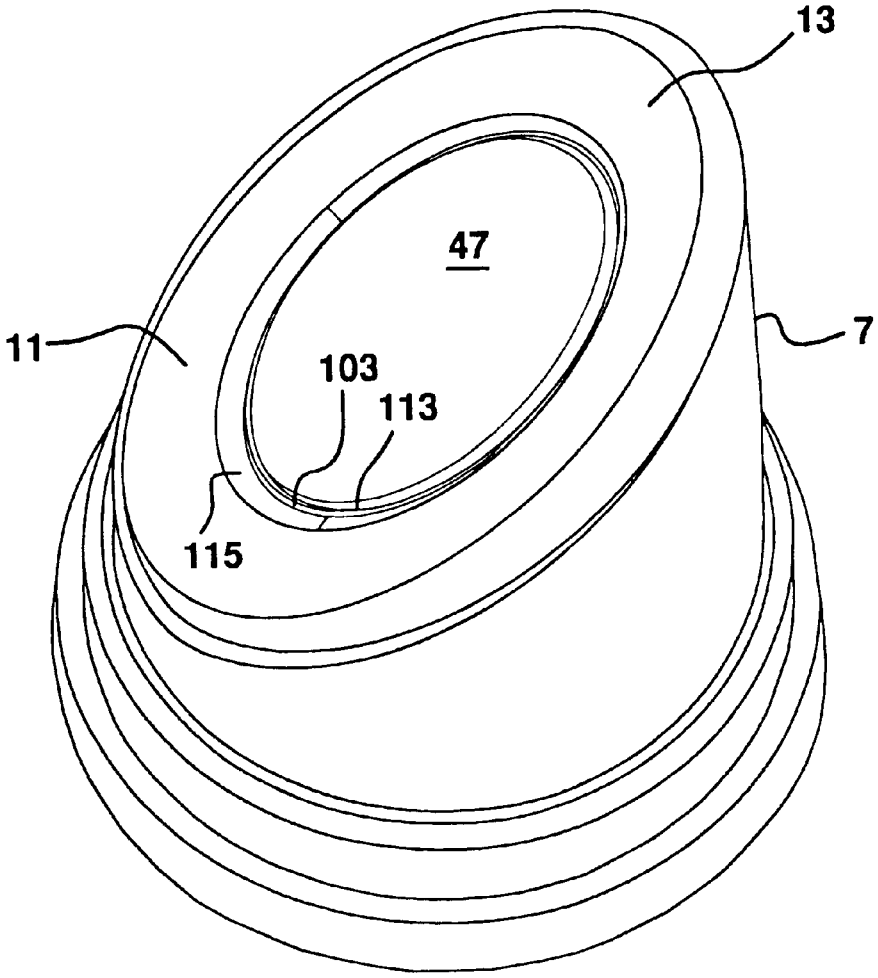
FIG. 48 shows an applicator top with a central valve.

In FIG. 48 the valve 47 is shown seated with outer thin area 113, seated against the ledge 103. The rounded wall 115 helps to distribute the material outwardly on the applicator surfaces 11 and 13.

Figure 49:
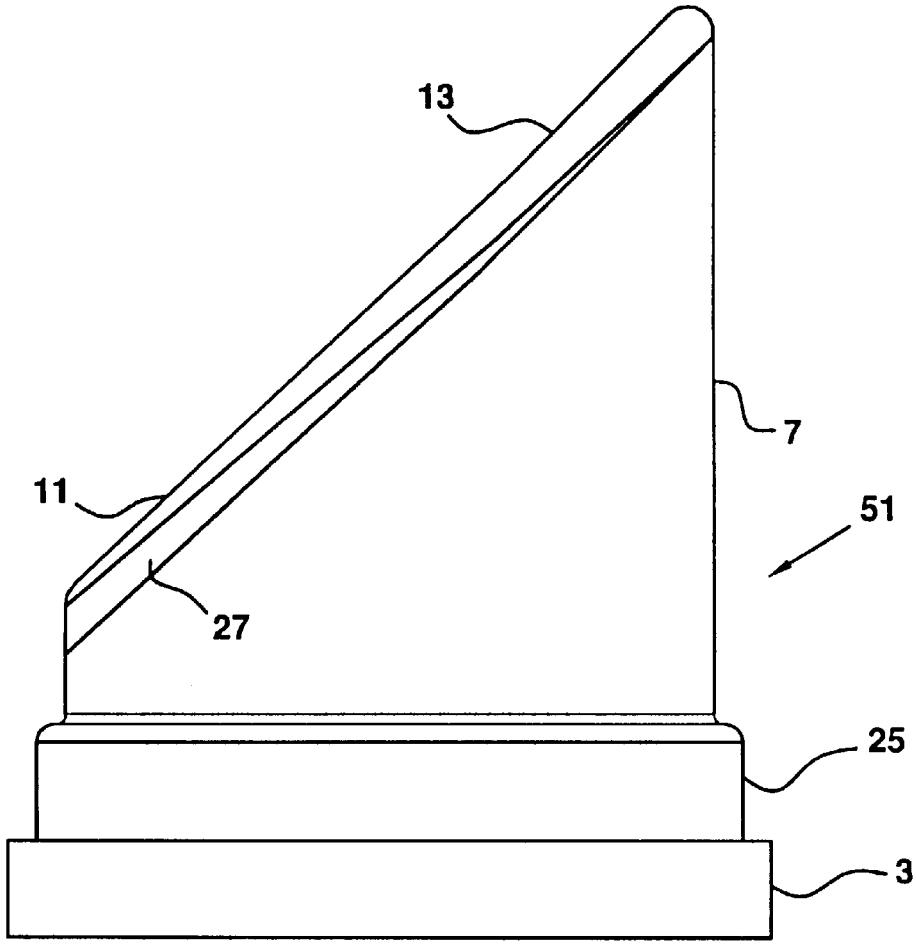
FIG. 49 is a side view of an applicator top.

The side view in FIG. 49 shows that the valve is completely recessed below the applicator surfaces 11 and 13.

Figure 50:
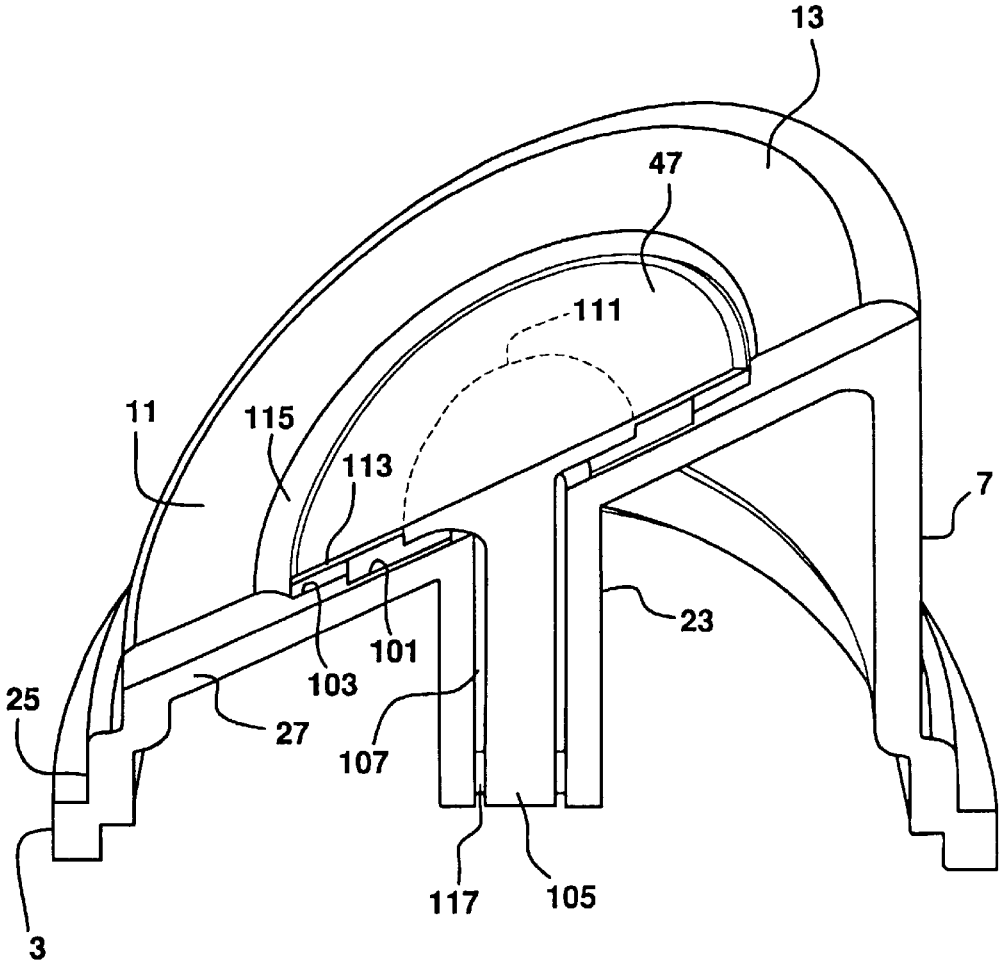
FIG. 50 is a detail of the compliant valve.

FIG. 50 shows the thin outer flange 113 of valve 47 resting on the recess surface 103 to close the valve until pressure is exerted on the material to flow the material outward across the curved surface 115 onto the applicator surfaces 11 and 13.

Welded areas 117 in two or more places around the valve stem maintain the flow channel 107 while holding the valve stem 105 fixed within the flow tube 23.

Figure 51:
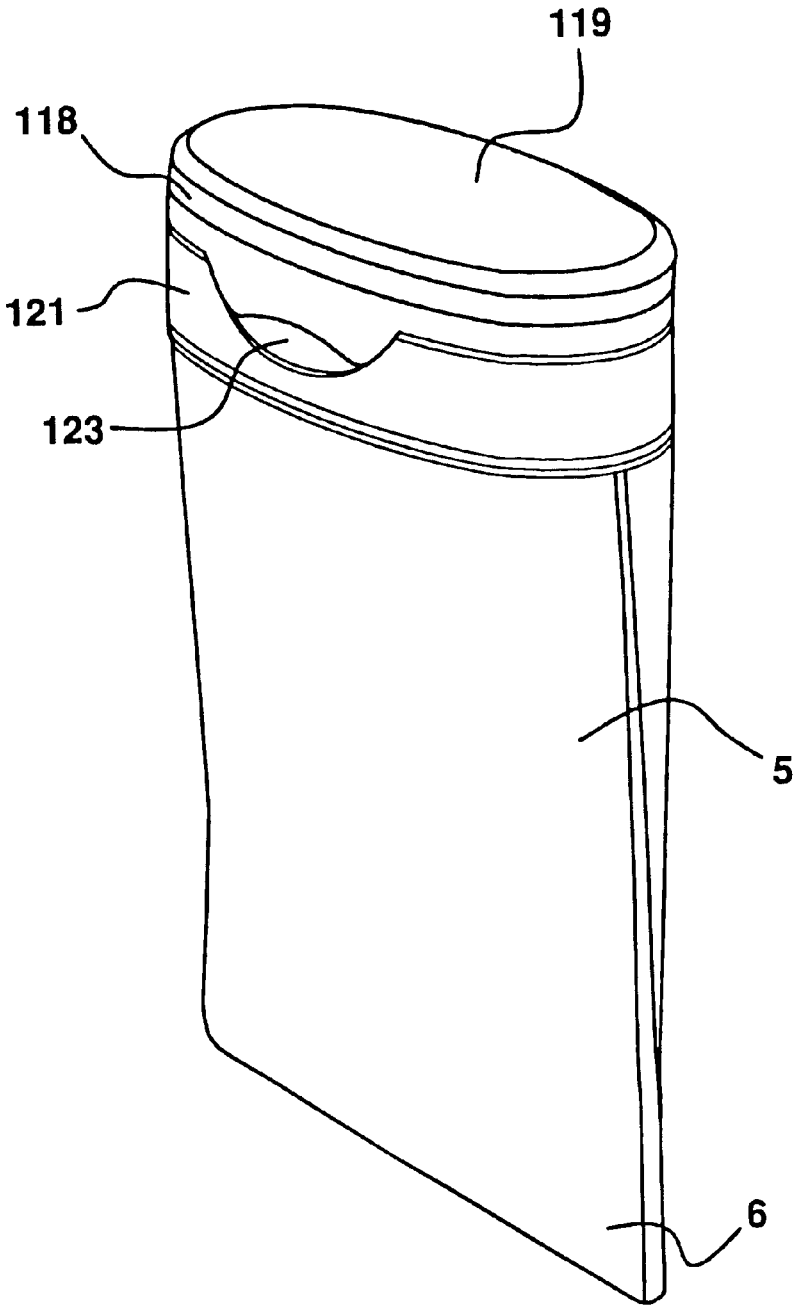
FIG. 51 shows a side view of an non-angled applicator cap and content sections.

FIG. 51 shows a flat head embodiment 118 with the cap 119 and applicator head section 121 in the closed position using snap 123. The applicator head 121 is fused, or concurrently formed with the content section 5. The lower end 60 of the body 5 is welded, fused, or crimped and sealed after the body has been filled with the contents.

Figure 52:
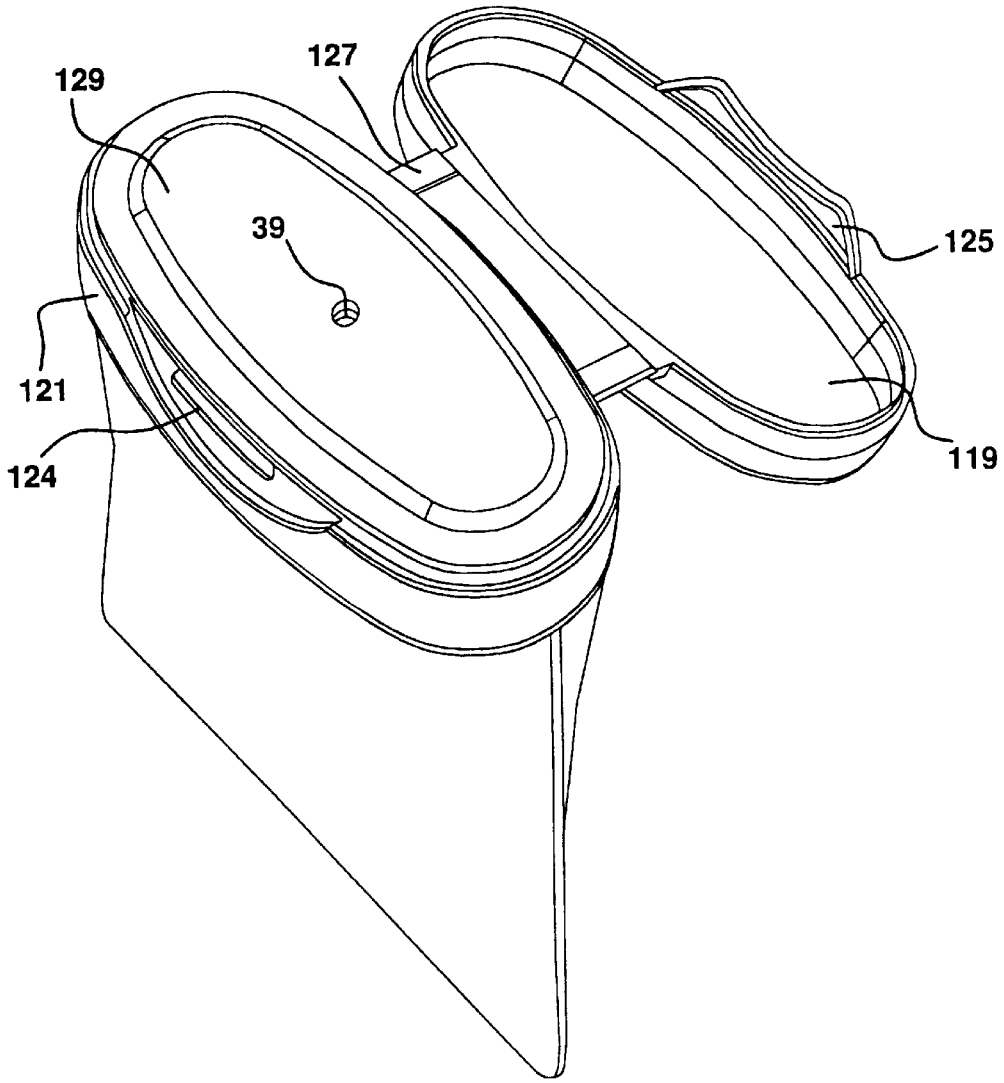
FIG. 52 is a detail of the snap section and double hinge of the cap shown in FIG. 51.

FIG. 52 shows the applicator 118 and head section 121 with the cap 119 in the open position. The snap portion 125 of cap 119 clips onto the snap projection 124. The contents from the container body 5 are distributed onto the flexible contact surface 129 through the dispenser hole 39. Double hinge 127 allows the cap 119 to be positioned away from the contact surface during use. The application contact surface 129 and the rim 130 are formed of an elastic plastimer with a similar base formulation to the polypropylene or polyethylene container 5 and cap 119.

Figure 53:
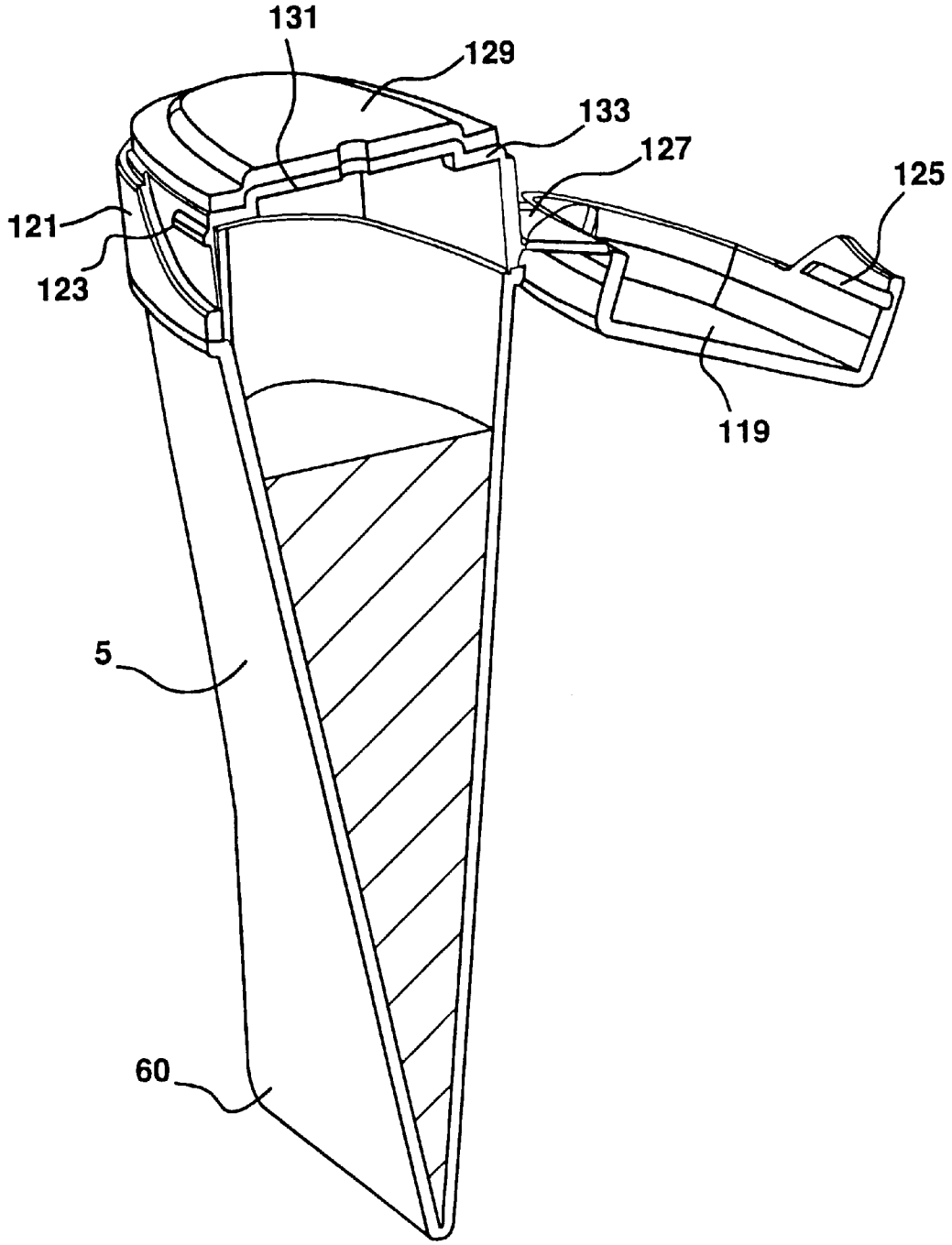
FIG. 53 is a detail of the applicator area and contact surface for the cap shown in FIG. 51.

As shown in FIG. 53, the applicator head section 121 is formed from two shots of material. The first shot of material forms the tube 5, the head 121, the cap 119 and snap 125, and the central applicator support area 131. A second shot of compliant material laminates on the applicator area 131 to form the contact surface 129 and the surrounding support 132.

Figure 54:
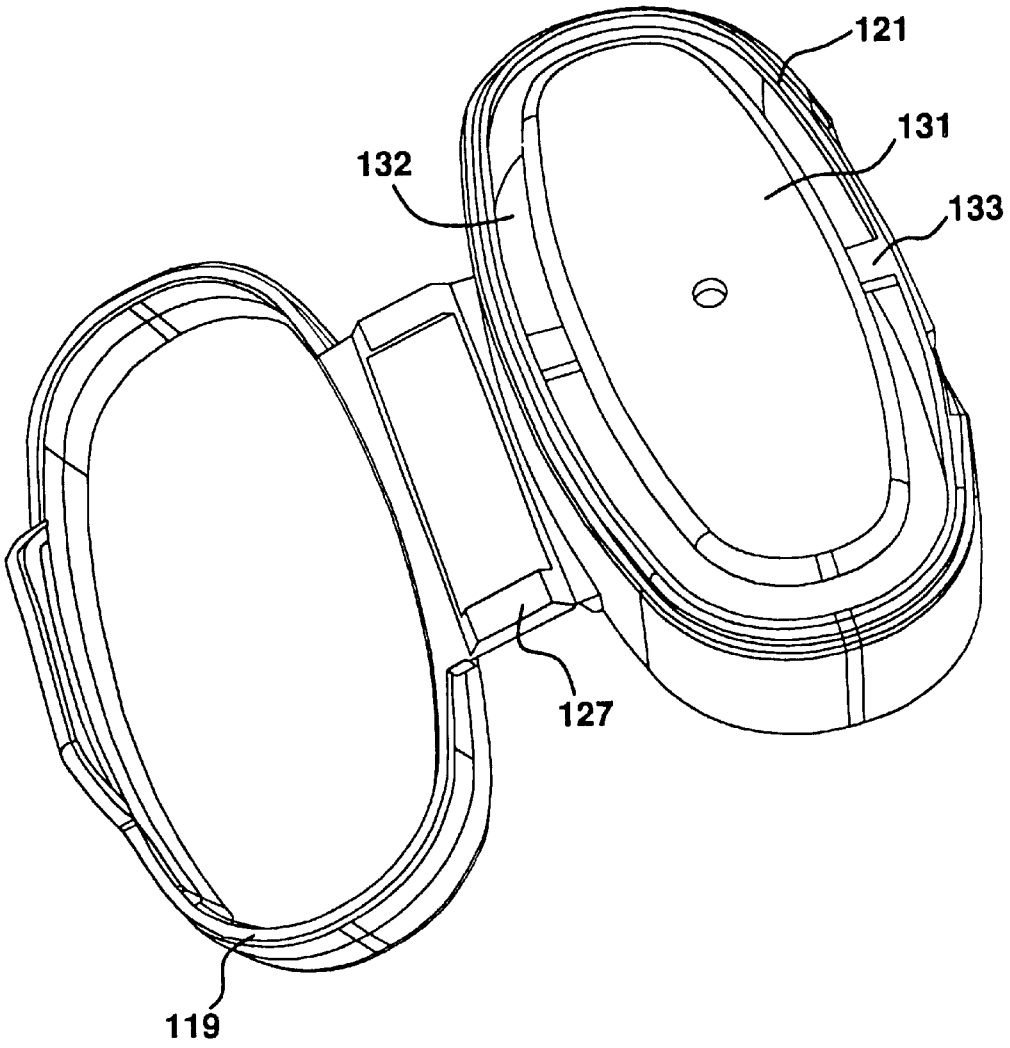
FIG. 54 shows the applicator area prior to receiving the second shot of contact surface material.

FIG. 54 depicts the applicator area 131 suspended within the head section 121 by connector elements 133, which form flow paths 132 for flowing material to laminate the applicator support area 131. The second shot of material fills flow paths 132 to form a compliant membrane 134.

Figure 55:
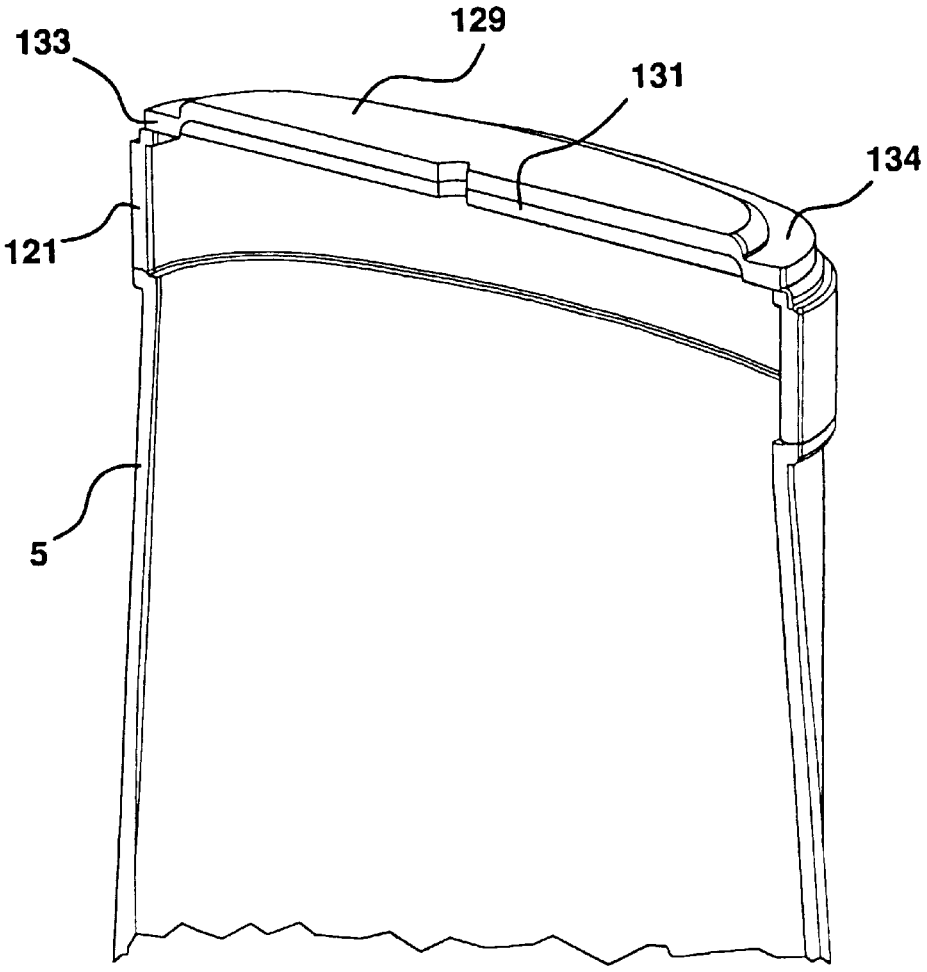
FIG. 55 is an alternate detail showing a side view of the applicator area and contact surface.

In FIG. 55 the applicator area 131 is shown suspended inside the head section 121 by a compliant membrane 134 between the applicator area 131 and the head section 121. The first shot molds the applicator head 121 and floating applicator support area 131. The applicator support area 131 is connected by one or more straps 133 to the applicator head section 121. The second shot forms a contact surface 129 that is compliant. The second shot also forms an unsupported membrane 134 between the applicator support area 131 and the head section 121.

Figure 56:
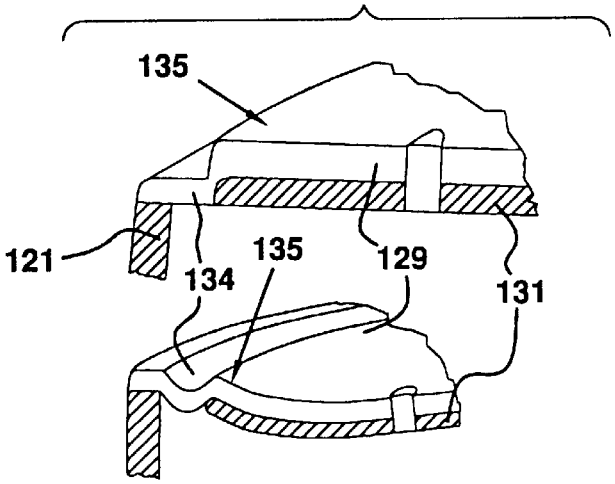
FIGS. 56 and 57 show the applicator area after the contact surface has been formed and depicts the flexing action of the applicator area in response to an applied force.
Figure 57:
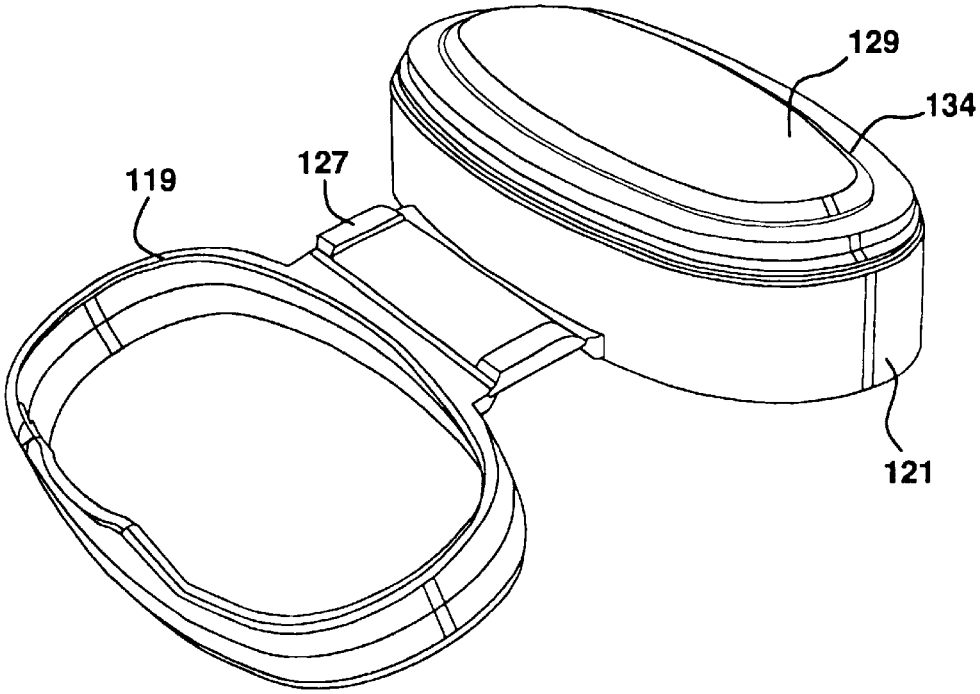

FIGS. 56 and 57 show the conformable floating contact surface 129 and membrane 134 flexing in response to a force 135 applied to the contact surface 129. Because the contact surface 129 created by the second shot is compliant and unsupported around the outer edge of the head section 121 created by the first shot, the applicator surface 129 can conform to forces presented to its surface.

While the invention has been described with reference to specific embodiments, modifications and variations of the invention may be constructed without departing from the scope of the invention.

We claim:

1. An applicator apparatus comprising a fluid container body end having a structure formed of molded plastic support material, a relatively compliant molded plastic material integrally formed on and at least partially covering a surface of the plastic support material for forming a compliant applicator surface directly on the support material and a fluid channel extending through the end and through the support material and positioned adjacent to the compliant material for flowing fluid to be applied by the compliant applicator surface outward from the channel to the applicator surface.

2. The applicator apparatus of claim 1, further comprising a connector positioned on the end remote from the compliant applicator surface for connecting the end to a fluid container body and for connecting the channel with the interior of the fluid container.

3. The applicator apparatus of claim 1, further comprising a fluid container body integrally formed on the end remote from the compliant applicator surface and connecting the channel.

4. The applicator apparatus of claim 1, further comprising a fluid container body integrally formed on the end remote from the compliant applicator surface and connecting a channel valve in the channel.

5. The applicator apparatus of claim 1, further comprising a fluid container body integrally formed on the end remote from the compliant applicator surface and connecting a channel opening in the channel.

6. The applicator apparatus of claim 1, further comprising a fluid container body integrally formed on the end remote from the compliant applicator surface and connecting a hinged cap with a plug extending from the cap into an opening.

7. The applicator apparatus of claim 1, further comprising the body end with a distal surface and a proximal connector connecting the compliant applicator surface on the distal surface.

8. The applicator apparatus of claim 1, further comprising the body end with a sloped distal surface and a proximal connector connecting a compliant applicator surface on the sloped distal surface.

9. The applicator apparatus of claim 1, further comprising the body end with a distal surface having a compliant applicator surface that covers the distal surface.

10. The applicator apparatus of claim 1, further comprising the body end with a distal surface having a compliant applicator surface that covers about half of the distal surface.

11. The applicator apparatus of claim 1, further comprising an end with a distal surface having a compliant applicator surface that covers an outer annular portion of the distal surface.

12. The applicator apparatus of claim 1, further comprising an integral hinged cap.

13. The applicator apparatus of claim 1, further comprising an integral double-hinged cap.

14. The applicator apparatus of claim 1, further comprising an socket on end to receive cap connector.

15. The applicator apparatus of claim 1, further comprising an exposed channel opening and channel that flexes in response to force applied to distal surface toward proximal portion pushing fluid through channel onto compliant applicator surface.

16. The applicator apparatus of claim 1, further comprising a molded flow control valve having a shaft within a material flow tube.

17. The applicator apparatus of claim 1, further comprising a hinged cap simultaneously formed during first shot of molding having double hinges to position cap away from applicator surface.

18. The applicator apparatus of claim 1, further comprising a compliant applicator surface formed during the second shot of the molding.

19. The applicator apparatus of claim 1, further comprising a hinged cap with flat exterior surface containing a lenticular lens having underlying interlineated images.

20. The hinged cap of claim 12, further comprising wraparound extensions that grasp the sides of applicator apparatus to fasten cap in closed position.

* * * * *